US008340976B2

(12) United States Patent
Ashley et al.

(10) Patent No.: US 8,340,976 B2
(45) **Date of Patent: *Dec. 25, 2012**

(54) METHOD AND APPARATUS FOR GENERATING AN ENHANCEMENT LAYER WITHIN A MULTIPLE-CHANNEL AUDIO CODING SYSTEM

(75) Inventors: James P. Ashley, Naperville, IL (US); Udar Mittal, Hoffman Estates, IL (US)

(73) Assignee: Motorola Mobility LLC, Libertyville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/439,624

(22) Filed: Apr. 4, 2012

(65) Prior Publication Data

US 2012/0226506 A1 Sep. 6, 2012

Related U.S. Application Data

(63) Continuation of application No. 12/345,165, filed on Dec. 29, 2008, now Pat. No. 8,175,888.

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS

| | | | |
|---|---|---|---|
| 4,560,977 | A | 12/1985 | Murakami et al. |
| 4,670,851 | A | 6/1987 | Murakami et al. |
| 4,727,354 | A | 2/1988 | Lindsay |
| 4,853,778 | A | 8/1989 | Tanaka |
| 5,006,929 | A | 4/1991 | Barbero et al. |
| 5,067,152 | A | 11/1991 | Kisor et al. |
| 5,327,521 | A | 7/1994 | Savic et al. |
| 5,394,473 | A | 2/1995 | Davidson |
| 5,956,674 | A | 9/1999 | Smyth et al. |
| 6,108,626 | A | 8/2000 | Cellario et al. |
| 6,236,960 | B1 | 5/2001 | Peng et al. |
| 6,253,185 | B1 | 6/2001 | Arean et al. |
| 6,263,312 | B1 | 7/2001 | Kolesnik et al. |
| 6,304,196 | B1 | 10/2001 | Copeland et al. |

(Continued)

FOREIGN PATENT DOCUMENTS

EP 0932141 A2 7/1999

(Continued)

OTHER PUBLICATIONS

United States Patent and Trademark Office, "Non-Final Office Action" for U.S. Appl. No. 12/196,414 dated Jun. 4, 2012, 9 pages.

(Continued)

*Primary Examiner* — Michael N Opsasnick
(74) *Attorney, Agent, or Firm* — Roland K. Bowler, II

(57) ABSTRACT

A method and apparatus are disclosed for generating a coded audio signal based on a multiple channel audio input signal. A balance factor having balance factor components each associated with an audio signal of the multiple channel audio signal is generated. A gain value to be applied to the coded audio signal to generate an estimate of the multiple channel audio signal based on the balance factor and the multiple channel audio signal is determined, with the gain value configured to minimize a distortion value between the multiple channel audio signal and the estimate of the multiple channel audio signal.

18 Claims, 19 Drawing Sheets

U.S. PATENT DOCUMENTS

| | | | | |
|---|---|---|---|---|
| 6,453,287 | B1 | 9/2002 | Unno et al. | |
| 6,493,664 | B1 * | 12/2002 | Udaya Bhaskar et al. | 704/222 |
| 6,504,877 | B1 | 1/2003 | Lee | |
| 6,593,872 | B2 | 7/2003 | Makino et al. | |
| 6,658,383 | B2 | 12/2003 | Koishida et al. | |
| 6,662,154 | B2 | 12/2003 | Mittal et al. | |
| 6,691,092 | B1 * | 2/2004 | Udaya Bhaskar et al. | 704/265 |
| 6,704,705 | B1 | 3/2004 | Kabal et al. | |
| 6,775,654 | B1 | 8/2004 | Yokoyama et al. | |
| 6,813,602 | B2 | 11/2004 | Thyssen | |
| 6,940,431 | B2 | 9/2005 | Hayami | |
| 6,975,253 | B1 | 12/2005 | Dominic | |
| 7,031,493 | B2 | 4/2006 | Fletcher et al. | |
| 7,130,796 | B2 | 10/2006 | Tasaki | |
| 7,161,507 | B2 | 1/2007 | Tomic | |
| 7,212,973 | B2 | 5/2007 | Toyama et | |
| 7,230,550 | B1 | 6/2007 | Mittal et al. | |
| 7,231,091 | B2 | 6/2007 | Keith | |
| 7,414,549 | B1 | 8/2008 | Yang et al. | |
| 7,461,106 | B2 | 12/2008 | Mittal et al. | |
| 7,761,290 | B2 * | 7/2010 | Koishida et al. | 704/222 |
| 7,840,411 | B2 | 11/2010 | Hotho et al. | |
| 7,885,819 | B2 * | 2/2011 | Koishida et al. | 704/500 |
| 2002/0052734 | A1 | 5/2002 | Unno et al. | |
| 2003/0004713 | A1 | 1/2003 | Makino et al. | |
| 2003/0009325 | A1 | 1/2003 | Kirchherr et al. | |
| 2003/0220783 | A1 | 11/2003 | Streich et al. | |
| 2004/0252768 | A1 | 12/2004 | Suzuki et al. | |
| 2005/0261893 | A1 | 11/2005 | Toyama et al. | |
| 2006/0022374 | A1 | 2/2006 | Chen et al. | |
| 2006/0047522 | A1 | 3/2006 | Ojanpera | |
| 2006/0173675 | A1 | 8/2006 | Ojanpera | |
| 2006/0190246 | A1 | 8/2006 | Park | |
| 2006/0241940 | A1 | 10/2006 | Ramprashad | |
| 2007/0171944 | A1 | 7/2007 | Schuijers et al. | |
| 2007/0239294 | A1 | 10/2007 | Brueckner et al. | |
| 2007/0271102 | A1 | 11/2007 | Morii | |
| 2008/0065374 | A1 | 3/2008 | Mittal et al. | |
| 2008/0120096 | A1 | 5/2008 | Oh et al. | |
| 2009/0024398 | A1 | 1/2009 | Mittal et al. | |
| 2009/0030677 | A1 | 1/2009 | Yoshida | |
| 2009/0076829 | A1 | 3/2009 | Ragot et al. | |
| 2009/0100121 | A1 | 4/2009 | Mittal et al. | |
| 2009/0112607 | A1 | 4/2009 | Ashley et al. | |
| 2009/0231169 | A1 | 9/2009 | Mittal et al. | |
| 2009/0234642 | A1 | 9/2009 | Mittal et al. | |
| 2009/0259477 | A1 | 10/2009 | Ashley et al. | |
| 2009/0276212 | A1 | 11/2009 | Khalil et al. | |
| 2009/0306992 | A1 | 12/2009 | Ragot et al. | |
| 2009/0326931 | A1 | 12/2009 | Ragot et al. | |
| 2010/0088090 | A1 | 4/2010 | Ramabadran | |
| 2010/0169087 | A1 | 7/2010 | Ashley et al. | |
| 2010/0169099 | A1 | 7/2010 | Ashley et al. | |
| 2011/0161087 | A1 | 6/2011 | Ashley et al. | |
| 2011/0218797 | A1 | 9/2011 | Mittal et al. | |

FOREIGN PATENT DOCUMENTS

| | | | |
|---|---|---|---|
| EP | 1483759 | | 8/2004 |
| EP | 1533789 | | 5/2005 |
| EP | 2619664 | | 1/2006 |
| EP | 1818911 | A1 | 8/2007 |
| EP | 1845519 | | 10/2007 |
| EP | 1912206 | A1 | 4/2008 |
| EP | 1959431 | B1 | 6/2010 |
| WO | 9715983 | | 10/1996 |
| WO | 03073741 | A2 | 9/2003 |
| WO | 2007063910 | A1 | 6/2007 |
| WO | 2008063035 | A1 | 5/2008 |
| WO | 2010003663 | A1 | 1/2010 |

OTHER PUBLICATIONS

Ratko V. Tomic: "Fast, Optimal Entropy Coder" 1stWorks Corporation Technical Report TR04-0815, Aug. 15, 2004, pp. 1-52.

Kyung Tae Kim et al.: "A new bandwidth scalable wideband speech/audio coder", 2002 IEEE International Conference on Acoustics, Speech, and Signal Processing Proceedings, (ICASSP), Orlando FL. May 13-17, 2002, [IEEE International Conference on Acoustics, Speech, and Signal Processing (ICASSP)], New York, NY, IEEE, US vol. 1, May 13, 2002, pp. 1-657.

Kovesi B et al.: "A scalable speech and audio coding scheme with continuous bitrate flexibility", Acoustics, Speech, and Signal Processing, 2004, Proceedings, (ICASSP '04), IEEE International Conference on Montreal, Quebec, Canada May 17-21, 2004, Piscataway, NJ, USA, IEEE, Piscataway, NJ, USA, vol. 1, May 17, 2004, pp. 273-276.

Markas T et al.: "Multispectral image compression algorithms", Data Compression Conference, 1993, DCC '93, Snowbird, UT, USA Mar. 30-Apr. 2, 1993, Los Alamitos, CA, USA IEEE Comput. Soc, US Mar. 30, 1993, p. 391-400.

"Enhanced Variable Rate Codec, Speech Service Options 3, 68 and 70 for Wideband Spread Spectrum Digital Systems", 3GPP2 TSG-C Working Group 2, XX, XX, No. C.S0014-C, Jan. 1, 2007, pp. 1-5.

Boris Ya Ryabko et al.: "Fast and Efficient Construction of an Unbiased Random Sequence", IEEE Transactions on Information Theory, IEEE, US, vol. 46, No. 3, May 1, 2000, ISSN: 0018-9448, pp. 1090-1093.

Ratko V. Tomic: "Quantized Indexing: Background Information", May 16, 2006, URL: http://web.archive.org/web/20060516161324/www.1stworks.com/ref/TR/tr05-0625a.pdf, pp. 1-39.

Ido Tal et al.: "On Row-by-Row Coding for 2-D Constraints", Information Theory, 2006 IEEE International Symposium on, IEEE, Pi, Jul. 1, 2006, pp. 1204-1208.

Ramprashad: "Embedded Coding Using a Mixed Speech and Audio Coding Paradigm" International Journal of Speech Technology Kluwer Academic Publishers Netherlands, Vo. 2, No. 4, May 1999, pp. 359-372.

Hung et al., Error-Resilient Pyramid Vector Quantization for Image Compression, IEEE Transactions on Image Processing, 1994 pp. 583-587.

Cadel, et al. "Pyramid Vector Coding for High Quality Audio Compression", IEEE 1997, pp. 343-346, Cefriel, Milano, Italy and Alcatel Telecom, Vimercate Italy.

Virette et al "Adaptive Time-Frequency Resolution in Modulated Transform at Reduced Delay" ICASSP 2008; pp. 3781-3784.

Edler "Coding of Audio Signals with Overlapping Block Transform and Adaptive Window Functions"; Journal of Vibration and Low Voltage fnr; vol. 43, 1989, Section 3.1.

Princen et al., "Subband/Transform Coding Using Filter Bank Designs Based on Time Domain Aliasing Cancellation" IEEE 1987; pp. 2161-2164.

Ramprashad, "High Quality Embedded Wideband Speech Coding Using an Inherently Layered Coding Paradigm," Proceedings of International Conference on Acoustics, Speech, and Signal Processing, ICASSP 2000, vol. 2, Jun. 5-9, 2000, pp. 1145-1148.

Ramprashad, "A Two Stage Hybrid Embedded Speech/Audio Coding Structure," Proceedings of Internationnal Conference on Acoustics, Speech, and Signal Processing, ICASSP 1998, May 1998, vol. 1, pp. 337-340, Seattle, Washington.

International Telecommunication Union, "G.729.1, Series G: Transmission Systems and Media, Digital Systems and Networks, Digital Terminal Equipments—Coding of analogue signals by methods other than PCM,G.729 based Embedded Variable bit-rate coder: An 8-32 kbits scalable wideband coder bitstream interoperable with G.729," ITU-T Recomendation G.729.1, May 2006, Cover page, pp. 11-18. Full document available at: http://www.itu.int/recIT-REC-G.729.1-200605-I/en.

Hung et al., Error-resilient pyramid vector quantization for image compression, IEEE Transactions on Image Processing, vol. 7, No. 10, Oct. 1,1998.

Mittal et al., Coding unconstrained FCB excitation using combinatorial and Huffman codes, Speech Coding 2002 IEEE Workshop Proceedings, Oct. 1,2002, pp. 129-131.

Ashley et al., Wideband coding of speech using a scalable pulse codebook, Speech Coding 2000 IEEE Workshop Proceedings, Sep. 1, 2000, pp. 148-150.

Mittal et al., Low complexity factorial pulse coding of MDCT coefficients using approximation of combinatorial functions, Acoustics, Speech and Signal Processing, 2007. ICASSP 2007. IEEE International Conference on, Apr. 1, 2007, pp. 1-289-1-292.

3rd Generation Partnership Project, Technical Specification Group Service and System Aspects;Audio codec processing functions; Extended Adaptive Multi-Rate—Wideband (AMR-WB+) codec; Transcoding functions (Release 7), V7.0.0, Mar. 1, 2007.
Chan et al., "Frequency domain postfiltering for multiband excited linear predictive coding of speech", in Electronics Letters, pp. 1061-1063, Feb. 27, 1996.
Chen et al., "Adaptive postfiltering for quality enhancement of coded speech", In IEEE Transactions on Speech and Audio Processing, Vol. 3, No. 1, pp. 59-71, Jan. 1, 1995.
Andersen et al., "Reverse water-filling in predictive encoding of speech", In 1999 IEEE Workshop on Speech Coding Proceedings, pp. 105-107,Jun. 20, 1999.
Makinen et al., "AMR-WB+: a new audio coding standard for 3rd generation mobile audio service", In 2005 Proceedings IEEE International Conference on Acoustics, Speech and Signal Processing, vol. 2, pp. ii/11 09-ii/1112, Mar. 18, 2005.
Faller et al., "Technical advances in digital audio radio broadcasting", Proceedings of the IEEE, vol. 90, No. 8, pp. 1303-1333, Aug. 1, 2002.
Salami et al., "Extended AMR-WB for High-Quality Audio on Mobile Devices", IEEE Communications Magazine, pp. 90-97, May 1, 2006.
Tancerel, L. et al., "Combined Speech and Audio Coding by Discrimination," In Proceedings of IEEE Workshop on Speech Coding, pp. 154-156, (2000).
Ramo et al. "Quality Evaluation of the G.EV-VBR Speech CODEC" Apr. 4, 2008, pp. 4745-4748.
Jelinek et al. "ITU-T G.EV-VBR Baseline CODEC" Apr. 4, 2008, pp. 4749-4752.
Jelinek et al. "Classification-Based Techniques for Improving the Robustness of CELP Coders" 2007, pp. 1480-1484.
Fuchs et al. "A Speech Coder Post-Processor Controlled by Side-Information" 2005, pp. IV-433-IV-436.
J. Fessler, "Chapter 2; Discrete-time signals and systems" May 27, 2004, pp. 2.1-2.21.
Mexican Patent Office, 2nd Office Action, Mexican Patent Application MX/a/2010/004479 (CML06419) dated Jan. 31, 2012, 5 pages.
Bruno Bessette: "Universal Speech/Audio Coding using Hybrid ACELP/TCX Techniques", Acoustics, Speech, and Signal Processing, 2005. Proceedings. (ICASSP '05). IEEE International Conference, Mar. 18-23, 2005, ISSN : III-301-III-304, Print ISBN: 0-78.
United States Patent and Trademark Office, "Non-Final Office Action" for U.S. Appl. No. 12/844,199 dated Aug. 31, 2012, 13pages.
Chinese Patent Office (SIPO), 1st Office Action for Chinese Patent Application No. 200980153318.0 dated Sep. 12, 2012, 6 pages.

* cited by examiner

200

— PRIOR ART —

300

— PRIOR ART —

400

METHOD AND APPARATUS FOR GENERATING AN ENHANCEMENT LAYER WITHIN A MULTIPLE-CHANNEL AUDIO CODING SYSTEM

CROSS-REFERENCE TO RELATED APPLICATIONS

The present application is a continuation of and commonly assigned U.S. application Ser. No. 12/345,165 filed on 29 Dec. 2008, now U.S. Pat. No. 8,175,888, the contents of which are incorporated herein by reference and from which benefits are claimed under 35 U.S.C. 120.

FIELD OF THE DISCLOSURE

The present invention relates, in general, to communication systems and, more particularly, to coding speech and audio signals in such communication systems.

BACKGROUND

Compression of digital speech and audio signals is well known. Compression is generally required to efficiently transmit signals over a communications channel, or to store compressed signals on a digital media device, such as a solid-state memory device or computer hard disk. Although there are many compression (or "coding") techniques, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yield the lowest distortion is then either transmitted or stored, and eventually used to reconstruct an estimate of the original input signal. CELP is a particular analysis-by-synthesis method that uses one or more codebooks that each essentially comprises sets of code-vectors that are retrieved from the codebook in response to a codebook index.

In modern CELP coders, there is a problem with maintaining high quality speech and audio reproduction at reasonably low data rates. This is especially true for music or other generic audio signals that do not fit the CELP speech model very well. In this case, the model mismatch can cause severely degraded audio quality that can be unacceptable to an end user of the equipment that employs such methods. Therefore, there remains a need for improving performance of CELP type speech coders at low bit rates, especially for music and other non-speech type inputs.

BRIEF DESCRIPTION OF THE DRAWINGS

The accompanying figures, where like reference numerals refer to identical or functionally similar elements throughout the separate views, which together with the detailed description below are incorporated in and form part of the specification and serve to further illustrate various embodiments of concepts that include the claimed invention, and to explain various principles and advantages of those embodiments.

Figure 1:
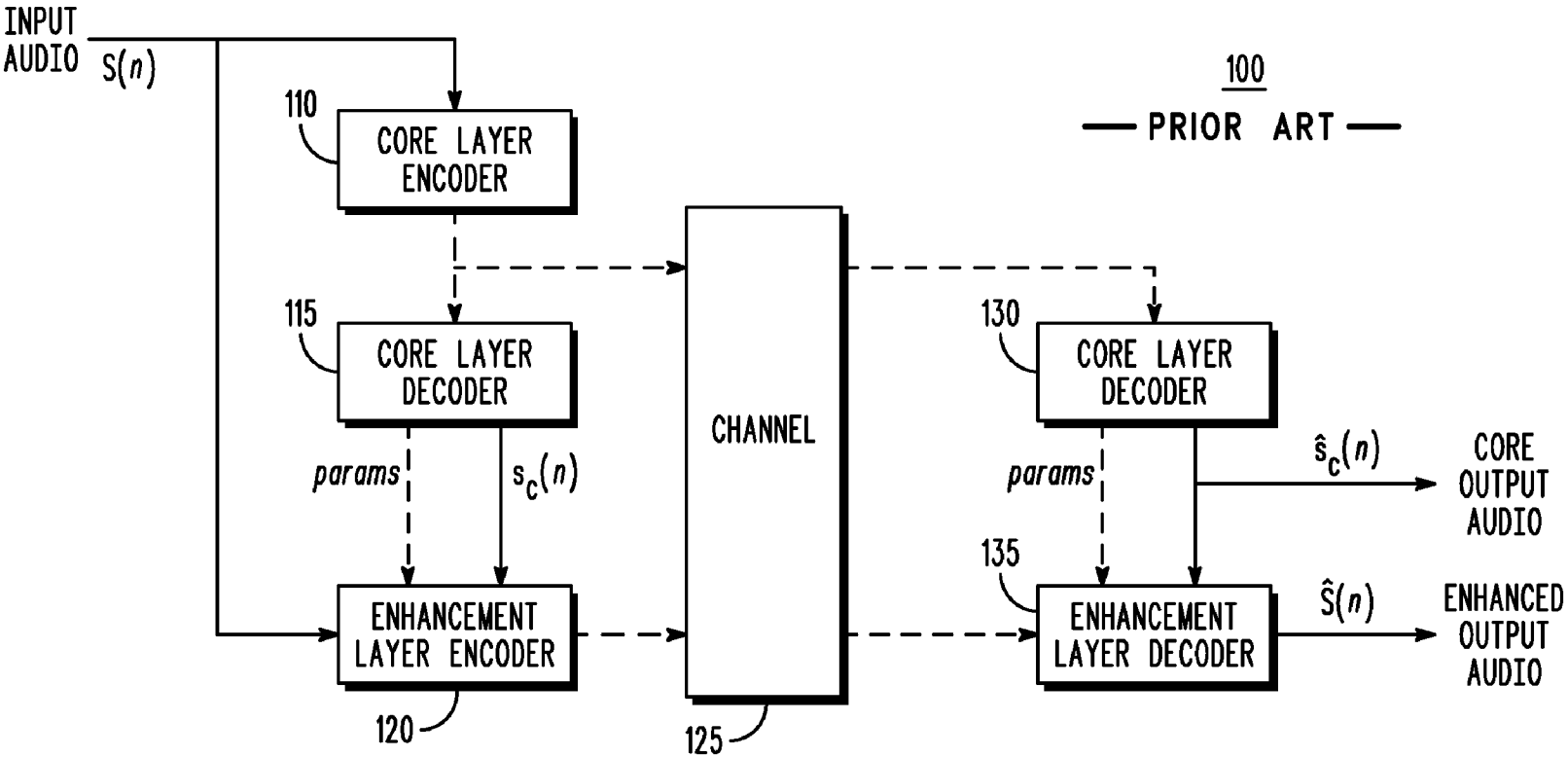
FIG. 1 is a block diagram of a prior art embedded speech/audio compression system.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. It will be further appreciated that certain actions and/or steps may be described or depicted in a particular order of occurrence while those skilled in the art will understand that such specificity with respect to sequence is not actually required. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

DETAILED DESCRIPTION

In order to address the above-mentioned need, a method and apparatus for generating an enhancement layer within an audio coding system is described herein. During operation an input signal to be coded is received and coded to produce a coded audio signal. The coded audio signal is then scaled with a plurality of gain values to produce a plurality of scaled coded audio signals, each having an associated gain value and a plurality of error values are determined existing between the input signal and each of the plurality of scaled coded audio signals. A gain value is then chosen that is associated with a scaled coded audio signal resulting in a low error value existing between the input signal and the scaled coded audio signal. Finally, the low error value is transmitted along with the gain value as part of an enhancement layer to the coded audio signal.

A prior art embedded speech/audio compression system is shown in FIG. 1. The input audio s(n) is first processed by a core layer encoder 120, which for these purposes may be a CELP type speech coding algorithm. The encoded bit-stream is transmitted to channel 125, as well as being input to a local core layer decoder 115, where the reconstructed core audio signal $s_c(n)$ is generated. The enhancement layer encoder 120 is then used to code additional information based on some comparison of signals s(n) and $s_c(n)$, and may optionally use parameters from the core layer decoder 115. As in core layer decoder 115, core layer decoder 130 converts core layer bit-stream parameters to a core layer audio signal $\hat{s}_c(n)$. The enhancement layer decoder 135 then uses the enhancement layer bit-stream from channel 125 and signal $\hat{s}_c(n)$ to produce the enhanced audio output signal s(n).

The primary advantage of such an embedded coding system is that a particular channel 125 may not be capable of consistently supporting the bandwidth requirement associated with high quality audio coding algorithms. An embedded coder, however, allows a partial bit-stream to be received (e.g., only the core layer bit-stream) from the channel 125 to produce, for example, only the core output audio when the enhancement layer bit-stream is lost or corrupted. However, there are tradeoffs in quality between embedded vs. non-embedded coders, and also between different embedded coding optimization objectives. That is, higher quality enhancement layer coding can help achieve a better balance between core and enhancement layers, and also reduce overall data rate for better transmission characteristics (e.g., reduced congestion), which may result in lower packet error rates for the enhancement layers.

Figure 2:
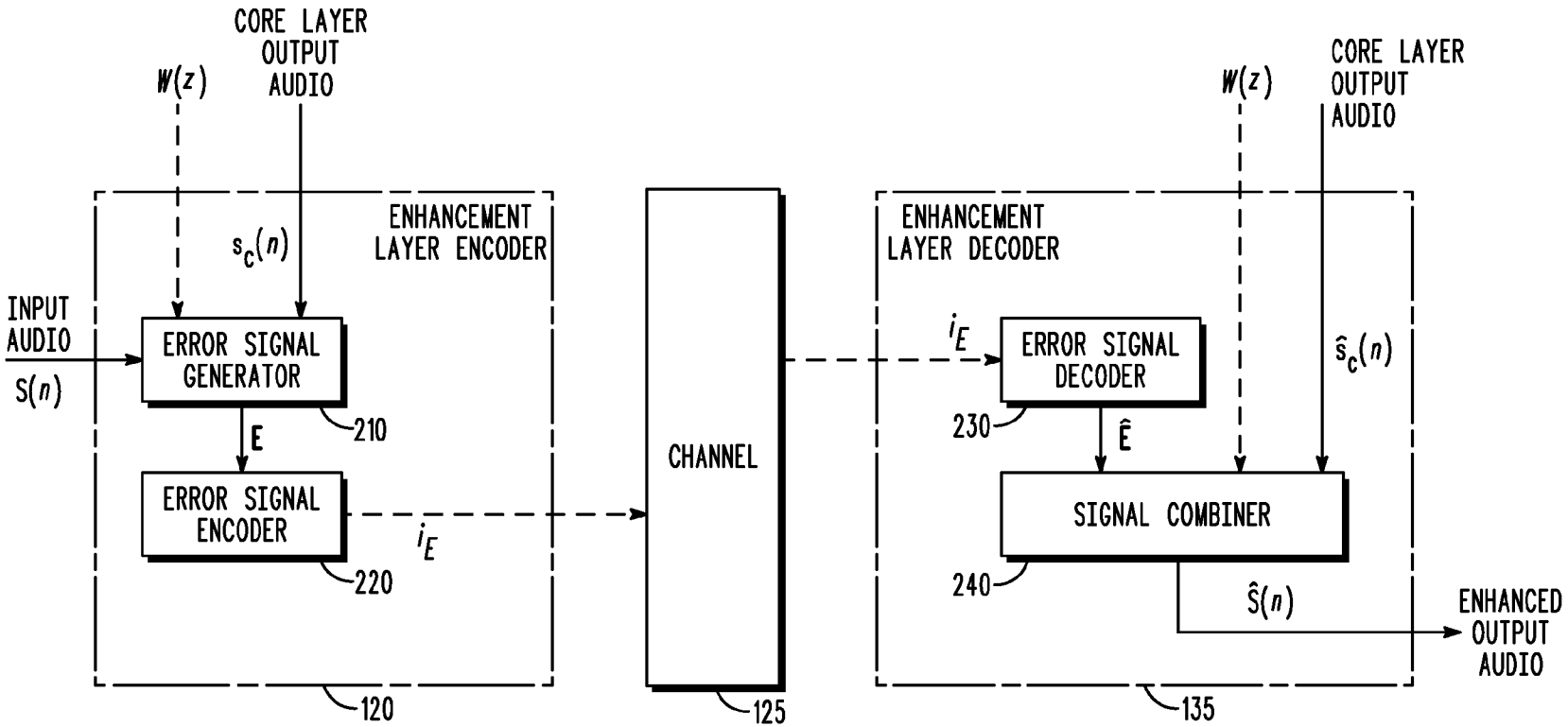
FIG. 2 is a more detailed example of the enhancement layer encoder of FIG. 1.

A more detailed example of a prior art enhancement layer encoder 120 is given in FIG. 2. Here, the error signal generator 210 is comprised of a weighted difference signal that is transformed into the Modified Discrete Cosine Transform (MDCT) domain for processing by error signal encoder 220. The error signal E is given as:

$$E=\mathrm{MDCT}\{W(s-s_c)\}, \tag{1}$$

where W is a perceptual weighting matrix based on the Linear Prediction (LP) filter coefficients A(z) from the core layer decoder 115, s is a vector (i.e., a frame) of samples from the input audio signal s(n), and $s_c$ is the corresponding vector of samples from the core layer decoder 115. An example MDCT process is described in ITU-T Recommendation G.729.1. The error signal E is then processed by the error signal encoder 220 to produce codeword $i_E$, which is subsequently transmitted to channel 125. For this example, it is important to note that error signal encoder 120 is presented with only one error signal E and outputs one associated codeword $i_E$. The reason for this will become apparent later.

The enhancement layer decoder 135 then receives the encoded bit-stream from channel 125 and appropriately demultiplexes the bit-stream to produce codeword $i_E$. The error signal decoder 230 uses codeword $i_E$ to reconstruct the enhancement layer error signal $\hat{E}$, which is then combined by signal combiner 240 with the core layer output audio signal $\hat{s}_c(n)$ as follows, to produce the enhanced audio output signal $\hat{s}(n)$:

$$\hat{s}=\hat{s}_c+W^{-1}\mathrm{MDCT}^{-1}\{\hat{E}\}, \tag{2}$$

where $\mathrm{MDCT}^{-1}$ is the inverse MDCT (including overlap-add), and $W^{-1}$ is the inverse perceptual weighting matrix.

Figure 3:
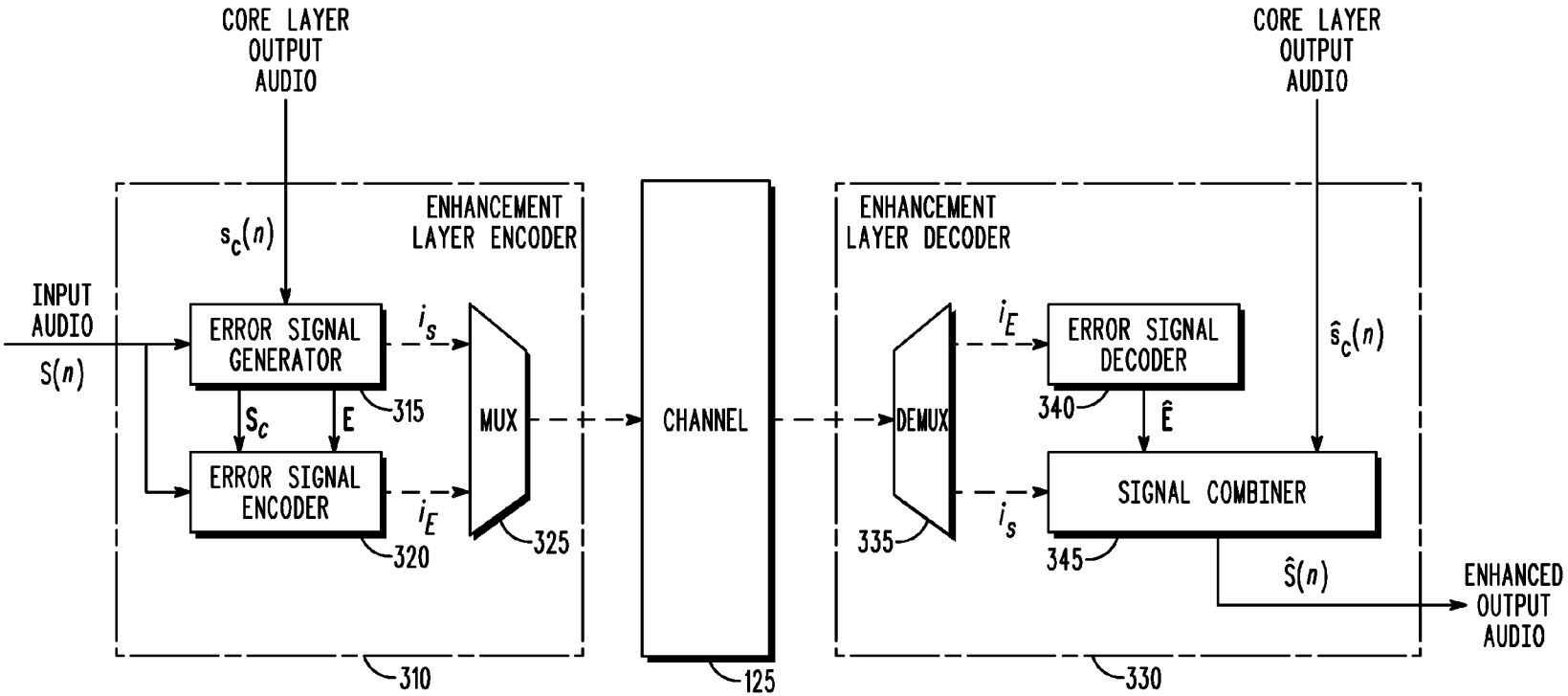
FIG. 3 is a more detailed example of the enhancement layer encoder of FIG. 1.

Another example of an enhancement layer encoder is shown in FIG. 3. Here, the generation of the error signal E by error signal generator 315 involves adaptive pre-scaling, in which some modification to the core layer audio output $s_c(n)$ is performed. This process results in some number of bits to be generated, which are shown in enhancement layer encoder 120 as codeword $i_s$.

Additionally, enhancement layer encoder 120 shows the input audio signal s(n) and transformed core layer output audio $S_c$ being inputted to error signal encoder 320. These signals are used to construct a psychoacoustic model for improved coding of the enhancement layer error signal E. Codewords $i_s$ and $i_E$ are then multiplexed by MUX 325, and then sent to channel 125 for subsequent decoding by enhancement layer decoder 135. The coded bit-stream is received by demux 335, which separates the bit-stream into components $i_s$ and $i_E$. Codeword $i_E$ is then used by error signal decoder 340 to reconstruct the enhancement layer error signal $\hat{E}$. Signal combiner 345 scales signal $\hat{s}_c(n)$ in some manner using scaling bits $i_s$, and then combines the result with the enhancement layer error signal $\hat{E}$ to produce the enhanced audio output signal $\hat{s}(n)$.

Figure 4:
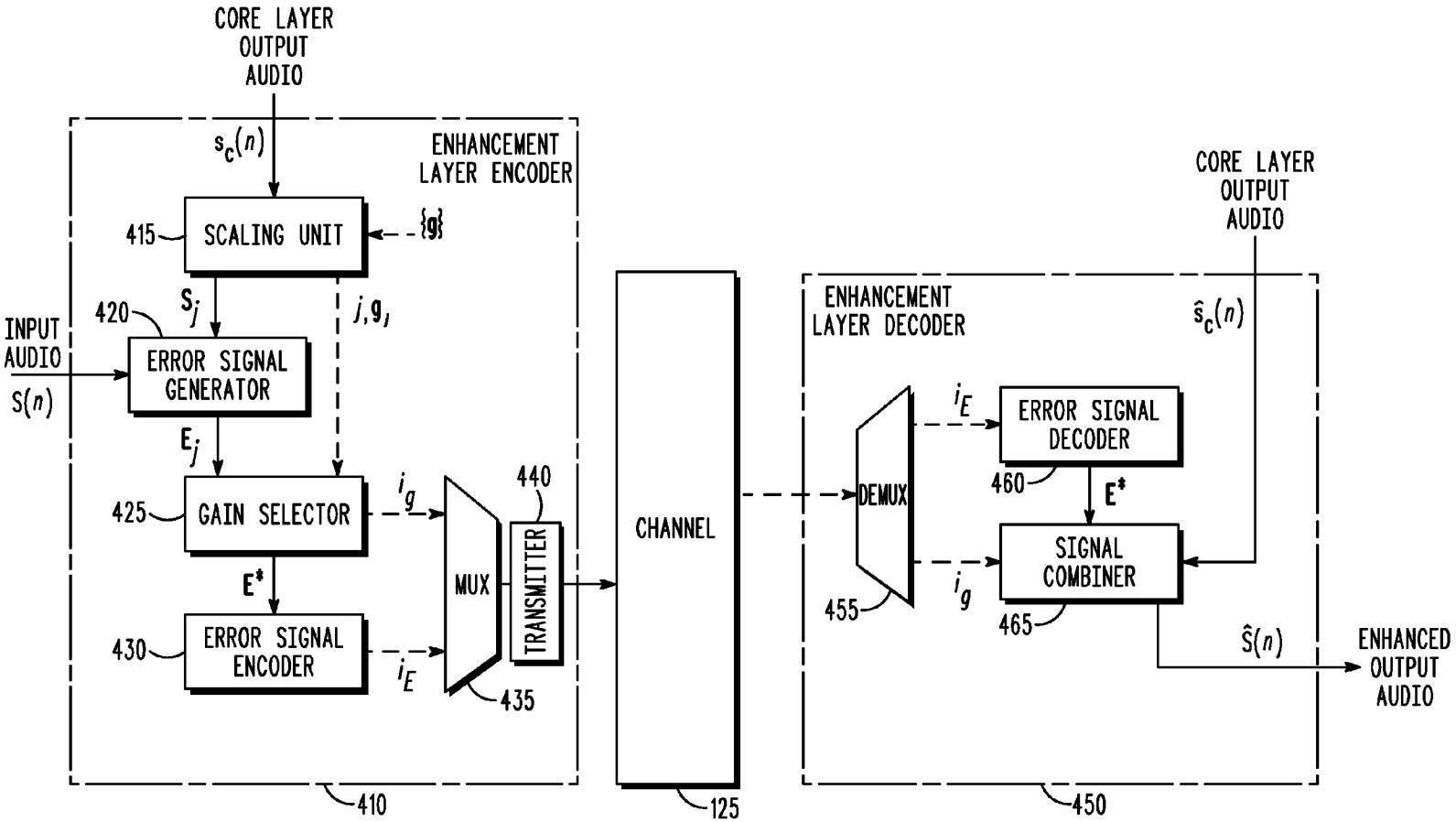
FIG. 4 is a block diagram of an enhancement layer encoder and decoder.

A first embodiment of the present invention is given in FIG. 4. This figure shows enhancement layer encoder 410 receiving core layer output signal $s_c(n)$ by scaling unit 415. A predetermined set of gains {g} is used to produce a plurality of scaled core layer output signals {S}, where $g_j$ and $S_j$ are the j-th candidates of the respective sets. Within scaling unit 415, the first embodiment processes signal $s_c(n)$ in the (MDCT) domain as:

$$S_j=G_j\times\mathrm{MDCT}\{Ws_c\};\ 0\leq j<M, \tag{3}$$

where W may be some perceptual weighting matrix, $s_c$ is a vector of samples from the core layer decoder 115, the MDCT is an operation well known in the art, and $G_j$ may be a gain matrix formed by utilizing a gain vector candidate $g_j$, and where M is the number gain vector candidates. In the first embodiment, $G_j$ uses vector $g_j$ as the diagonal and zeros everywhere else (i.e., a diagonal matrix), although many possibilities exist. For example, $G_j$ may be a band matrix, or may even be a simple scalar quantity multiplied by the identity matrix I. Alternatively, there may be some advantage to leaving the signal $S_j$ in the time domain or there may be cases where it is advantageous to transform the audio to a different domain, such as the Discrete Fourier Transform (DFT) domain. Many such transforms are well known in the art. In these cases, the scaling unit may output the appropriate $S_j$ based on the respective vector domain.

But in any case, the primary reason to scale the core layer output audio is to compensate for model mismatch (or some other coding deficiency) that may cause significant differences between the input signal and the core layer codec. For example, if the input audio signal is primarily a music signal and the core layer codec is based on a speech model, then the core layer output may contain severely distorted signal characteristics, in which case, it is beneficial from a sound quality perspective to selectively reduce the energy of this signal component prior to applying supplemental coding of the signal by way of one or more enhancement layers.

The gain scaled core layer audio candidate vector $S_j$ and input audio s(n) may then be used as input to error signal generator 420. In an exemplary embodiment, the input audio signal s(n) is converted to vector S such that S and $S_j$ are correspondingly aligned. That is, the vector s representing s(n) is time (phase) aligned with $s_c$, and the corresponding operations may be applied so that in this embodiment:

$$E_j=\mathrm{MDCT}\{Ws\}-S_j;\ 0\leq j<M \tag{4}$$

This expression yields a plurality of error signal vectors $E_j$ that represent the weighted difference between the input audio and the gain scaled core layer output audio in the MDCT spectral domain. In other embodiments where different domains are considered, the above expression may be modified based on the respective processing domain.

Gain selector 425 is then used to evaluate the plurality of error signal vectors $E_j$, in accordance with the first embodiment of the present invention, to produce an optimal error vector E*, an optimal gain parameter g*, and subsequently, a corresponding gain index $i_g$. The gain selector 425 may use a variety of methods to determine the optimal parameters, E* and g*, which may involve closed loop methods (e.g., minimization of a distortion metric), open loop methods (e.g., heuristic classification, model performance estimation, etc.), or a combination of both methods. In the exemplary embodiment, a biased distortion metric may be used, which is given as the biased energy difference between the original audio signal vector S and the composite reconstructed signal vector:

$$j^* = \underset{0 \le j < M}{\operatorname{argmin}}\{\beta_j \cdot \|S - (S_j + \hat{E}_j)\|^2\}, \tag{5}$$

where $\hat{E}_j$ may be the quantified estimate of the error signal vector $E_j$, and $\beta_j$ may be a bias term which is used to supplement the decision of choosing the perceptually optimal gain error index j*. An exemplary method for vector quantization of a signal vector is given in U.S. patent application Ser. No. 11/531,122, entitled APPARATUS AND METHOD FOR LOW COMPLEXITY COMBINATORIAL CODING OF SIGNALS, although many other methods are possible. Recognizing that $E_j = S - S_j$, equation (5) may be rewritten as:

$$j^* = \underset{0 \le j < M}{\operatorname{argmin}}\{\beta_j \cdot \|E_j + \hat{E}_j\|^2\}, \tag{6}$$

In this expression, the term $\epsilon_j = \|E_j - \hat{E}_j\|^2$ represents the energy of the difference between the unquantized and quantized error signals. For clarity, this quantity may be referred to as the "residual energy", and may further be used to evaluate a "gain selection criterion", in which the optimum gain parameter g* is selected. One such gain selection criterion is given in equation (6), although many are possible.

The need for a bias term $\beta_j$ may arise from the case where the error weighting function W in equations (3) and (4) may not adequately produce equally perceptible distortions across vector $\hat{E}_j$. For example, although the error weighting function W may be used to attempt to "whiten" the error spectrum to some degree, there may be certain advantages to placing more weight on the low frequencies, due to the perception of distortion by the human ear. As a result of increased error weighting in the low frequencies, the high frequency signals may be under-modeled by the enhancement layer. In these cases, there may be a direct benefit to biasing the distortion metric towards values of $g_j$ that do not attenuate the high frequency components of $S_j$, such that the under-modeling of high frequencies does not result in objectionable or unnatural sounding artifacts in the final reconstructed audio signal. One such example would be the case of an unvoiced speech signal. In this case, the input audio is generally made up of mid to high frequency noise-like signals produced from turbulent flow of air from the human mouth. It may be that the core layer encoder does not code this type of waveform directly, but may use a noise model to generate a similar sounding audio signal. This may result in a generally low correlation between the input audio and the core layer output audio signals. However, in this embodiment, the error signal vector $E_j$ is based on a difference between the input audio and core layer audio output signals. Since these signals may not be correlated very well, the energy of the error signal $E_j$ may not necessarily be lower than either the input audio or the core layer output audio. In that case, minimization of the error in equation (6) may result in the gain scaling being too aggressive, which may result in potential audible artifacts.

In another case, the bias factors $\beta_j$ may be based on other signal characteristics of the input audio and/or core layer output audio signals. For example, the peak-to-average ratio of the spectrum of a signal may give an indication of that signal's harmonic content. Signals such as speech and certain types of music may have a high harmonic content and thus a high peak-to-average ratio. However, a music signal processed through a speech codec may result in a poor quality due to coding model mismatch, and as a result, the core layer output signal spectrum may have a reduced peak-to-average ratio when compared to the input signal spectrum. In this case, it may be beneficial reduce the amount of bias in the minimization process in order to allow the core layer output audio to be gain scaled to a lower energy thereby allowing the enhancement layer coding to have a more pronounced effect on the composite output audio. Conversely, certain types speech or music input signals may exhibit lower peak-to-average ratios, in which case, the signals may be perceived as being more noisy, and may therefore benefit from less scaling of the core layer output audio by increasing the error bias. An example of a function to generate the bias factors for is given as:

$$\beta_j = \begin{cases} 1 + 10^6 \cdot j; & UVSpeech == \text{TRUE or } \phi_s < \lambda\phi_{s_c} \\ 10^{(-j\cdot\Delta/10)}; & \text{otherwise,} \end{cases} \quad 0 \le j < M. \tag{7}$$

where λ may be some threshold, and the peak-to-average ratio for vector $\phi_y$ may be given as:

$$\phi_y = \frac{\max\{|y_{k_1 k_2}|\}}{\frac{1}{k_2 - k_1 + 1}\sum_{k=k_1}^{k_2} |y(k)|}, \tag{8}$$

and where $y_{k_1 k_2}$ is a vector subset of y(k) such that $y_{k_1 k_2} = y(k)$; $k_1 \leqq k \leqq k_2$.

Once the optimum gain index j* is determined from equation (6), the associated codeword $i_g$ is generated and the optimum error vector E* is sent to error signal encoder 430, where E* is coded into a form that is suitable for multiplexing with other codewords (by MUX 440) and transmitted for use by a corresponding decoder. In an exemplary embodiment, error signal encoder 408 uses Factorial Pulse Coding (FPC). This method is advantageous from a processing complexity point of view since the enumeration process associated with the coding of vector E* is independent of the vector generation process that is used to generate $\hat{E}_j$.

Enhancement layer decoder 450 reverses these processes to produce the enhanced audio output ŝ(n). More specifically, $i_g$ and $i_E$ are received by decoder 450, with $i_E$ being sent by demux 455 to error signal decoder 460 where the optimum error vector E* is derived from the codeword. The optimum error vector E* is passed to signal combiner 465 where the received $\hat{s}_c(n)$ is modified as in equation (2) to produce $\hat{s}(n)$.

Figure 5:
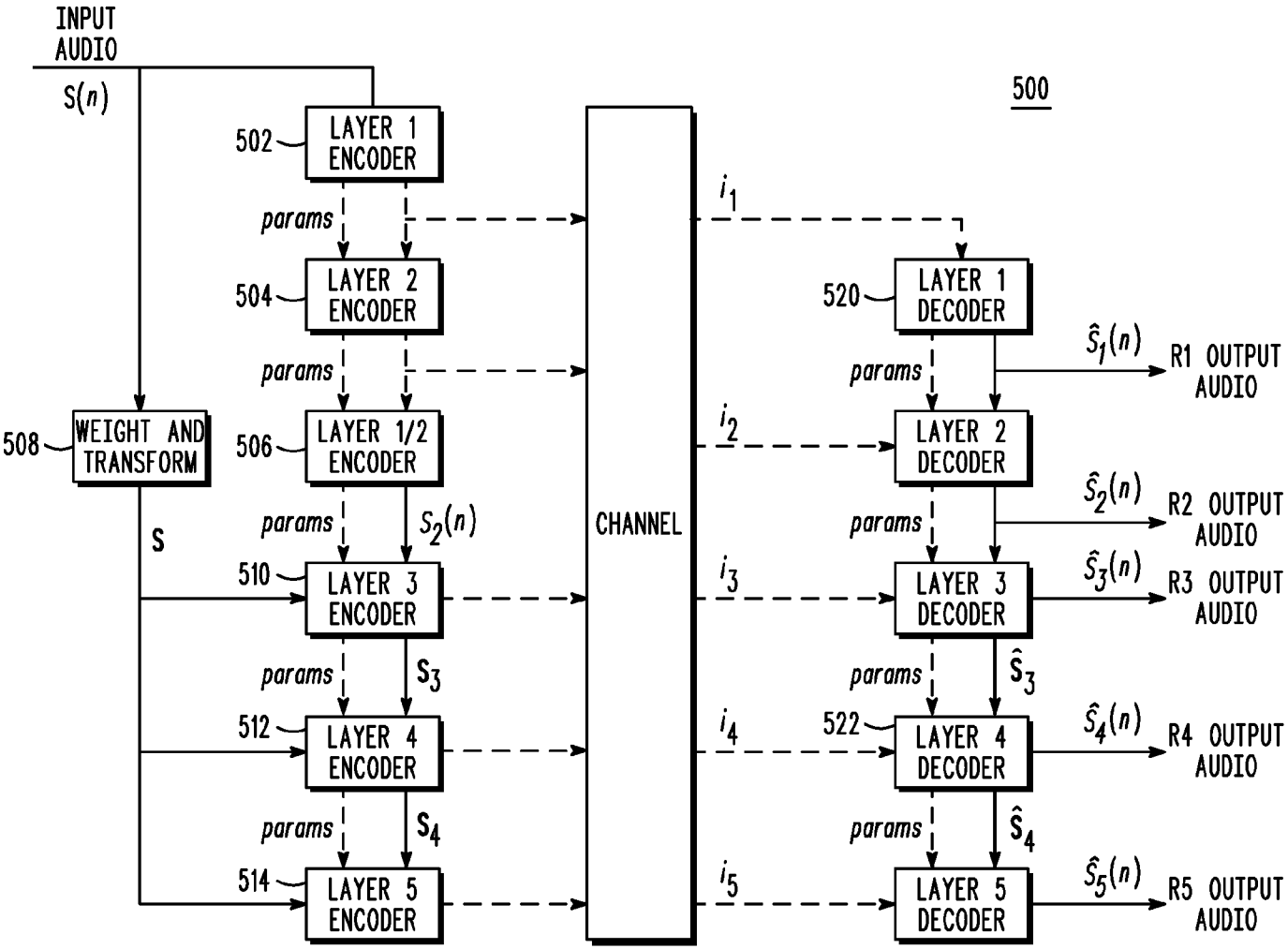
FIG. 5 is a block diagram of a multi-layer embedded coding system.

A second embodiment of the present invention involves a multi-layer embedded coding system as shown in FIG. 5. Here, it can be seen that there are five embedded layers given for this example. Layers 1 and 2 may be both speech codec based, and layers 3, 4, and 5 may be MDCT enhancement layers. Thus, encoders 502 and 503 may utilize speech codecs to produce and output encoded input signal s(n). Encoders 510, 610, and 514 comprise enhancement layer encoders, each outputting a differing enhancement to the encoded signal. Similar to the previous embodiment, the error signal vector for layer 3 (encoder 510) may be given as:

$$E_3=S-S_2, \tag{9}$$

where S=MDCT{Ws} is the weighted transformed input signal, and $S_2$=MDCT{$Ws_2$} is the weighted transformed signal generated from the layer 1/2 decoder 506. In this embodiment, layer 3 may be a low rate quantization layer, and as such, there may be relatively few bits for coding the corresponding quantized error signal $\hat{E}_3=Q\{E_3\}$. In order to provide good quality under these constraints, only a fraction of the coefficients within $E_3$ may be quantized. The positions of the coefficients to be coded may be fixed or may be variable, but if allowed to vary, it may be required to send additional information to the decoder to identify these positions. If, for example, the range of coded positions starts at $k_s$ and ends at $k_e$, where $0 \leqq k_s < k_e < N$, then the quantized error signal vector $\hat{E}_3$ may contain non-zero values only within that range, and zeros for positions outside that range. The position and range information may also be implicit, depending on the coding method used. For example, it is well known in audio coding that a band of frequencies may be deemed perceptually important, and that coding of a signal vector may focus on those frequencies. In these circumstances, the coded range may be variable, and may not span a contiguous set of frequencies. But at any rate, once this signal is quantized, the composite coded output spectrum may be constructed as:

$$S_3=\hat{E}_3+S_2, \tag{10}$$

which is then used as input to layer 4 encoder 610.

Layer 4 encoder 610 is similar to the enhancement layer encoder 410 of the previous embodiment. Using the gain vector candidate $g_j$, the corresponding error vector may be described as:

$$E_4(j)=S-G_jS_3, \tag{11}$$

where $G_j$ may be a gain matrix with vector $g_j$ as the diagonal component. In the current embodiment, however, the gain vector $g_j$ may be related to the quantized error signal vector $\hat{E}_3$ in the following manner. Since the quantized error signal vector $E_3$ may be limited in frequency range, for example, starting at vector position $k_s$ and ending at vector position $k_e$, the layer 3 output signal $S_3$ is presumed to be coded fairly accurately within that range. Therefore, in accordance with the present invention, the gain vector $g_j$ is adjusted based on the coded positions of the layer 3 error signal vector, $k_s$ and $k_e$. More specifically, in order to preserve the signal integrity at those locations, the corresponding individual gain elements may be set to a constant value α. That is:

$$g_j(k)=\begin{cases}\alpha; & k_s \le k \le k_e \\ \gamma_j(k); & \text{otherwise,}\end{cases} \tag{12}$$

where generally $0 \leqq \gamma_j(k) \leqq 1$ and $g_j(k)$ is the gain of the k-th position of the j-th candidate vector. In an exemplary embodiment, the value of the constant is one (α=1), however many values are possible. In addition, the frequency range may span multiple starting and ending positions. That is, equation (12) may be segmented into non-continuous ranges of varying gains that are based on some function of the error signal $\hat{E}_3$, and may be written more generally as:

$$g_j(k)=\begin{cases}\alpha; & \hat{E}_3(k) \neq 0 \\ \gamma_j(k); & \text{otherwise,}\end{cases} \tag{13}$$

For this example, a fixed gain α is used to generate $g_j(k)$ when the corresponding positions in the previously quantized error signal $\hat{E}_3$ are non-zero, and gain function $\gamma_j(k)$ is used when the corresponding positions in $\hat{E}_3$ are zero. One possible gain function may be defined as:

$$\gamma_j(k)=\begin{cases}\alpha \cdot 10^{(-j\Delta/20)}; & k_l \le k \le k_h \\ \alpha; & \text{otherwise,}\end{cases} \quad 0 \le j < M, \tag{14}$$

where Δ is a step size (e.g., Δ≈2.2 dB), α is a constant, M is the number of candidates (e.g., M=4, which can be represented using only 2 bits), and $k_l$ and $k_h$ are the low and high frequency cutoffs, respectively, over which the gain reduction may take place. The introduction of parameters $k_l$ and $k_h$ is useful in systems where scaling is desired only over a certain frequency range. For example, in a given embodiment, the high frequencies may not be adequately modeled by the core layer, thus the energy within the high frequency band may be inherently lower than that in the input audio signal. In that case, there may be little or no benefit from scaling the layer 3 output in that region signal since the overall error energy may increase as a result.

Summarizing, the plurality of gain vector candidates $g_j$ is based on some function of the coded elements of a previously coded signal vector, in this case $\hat{E}_3$. This can be expressed in general terms as:

$$g_j(k)=f(k,\hat{E}_3). \tag{15}$$

The corresponding decoder operations are shown on the right hand side of FIG. 5. As the various layers of coded bit-streams ($i_1$ to $i_5$) are received, the higher quality output signals are built on the hierarchy of enhancement layers over the core layer (layer 1) decoder. That is, for this particular embodiment, as the first two layers are comprised of time domain speech model coding (e.g., CELP) and the remaining three layers are comprised of transform domain coding (e.g., MDCT), the final output for the system s(n) is generated according to the following:

$$\hat{s}(n)=\begin{cases}\hat{s}_1(n); \\ \hat{s}_2(n)=\hat{s}_1(n)+\hat{e}_2(n); \\ \hat{s}_3(n)=W^{-1}MDCT^{-1}\{\hat{S}_2+\hat{E}_3\}; \\ \hat{s}_4(n)=W^{-1}MDCT^{-1}\{G_j\cdot(\hat{S}_2+\hat{E}_3)+\hat{E}_4\}; \\ \hat{s}_5(n)=W^{-1}MDCT^{-1}\{G_j\cdot(\hat{S}_2+\hat{E}_3)+\hat{E}_4+\hat{E}_5\};\end{cases} \tag{16}$$

where $\hat{e}_2(n)$ is the layer 2 time domain enhancement layer signal, and $\hat{S}_2$=MDCT{$Ws_2$} is the weighted MDCT vector corresponding to the layer 2 audio output $\hat{s}_2(n)$. In this expression, the overall output signal (n) may be determined from the highest level of consecutive bit-stream layers that are received. In this embodiment, it is assumed that lower level layers have a higher probability of being properly received from the channel, therefore, the codeword sets $\{i_1\}$, $\{i_1\ i_2\}$, $\{i_1\ i_2\ i_3\}$, etc., determine the appropriate level of enhancement layer decoding in equation (16).

Figure 6:
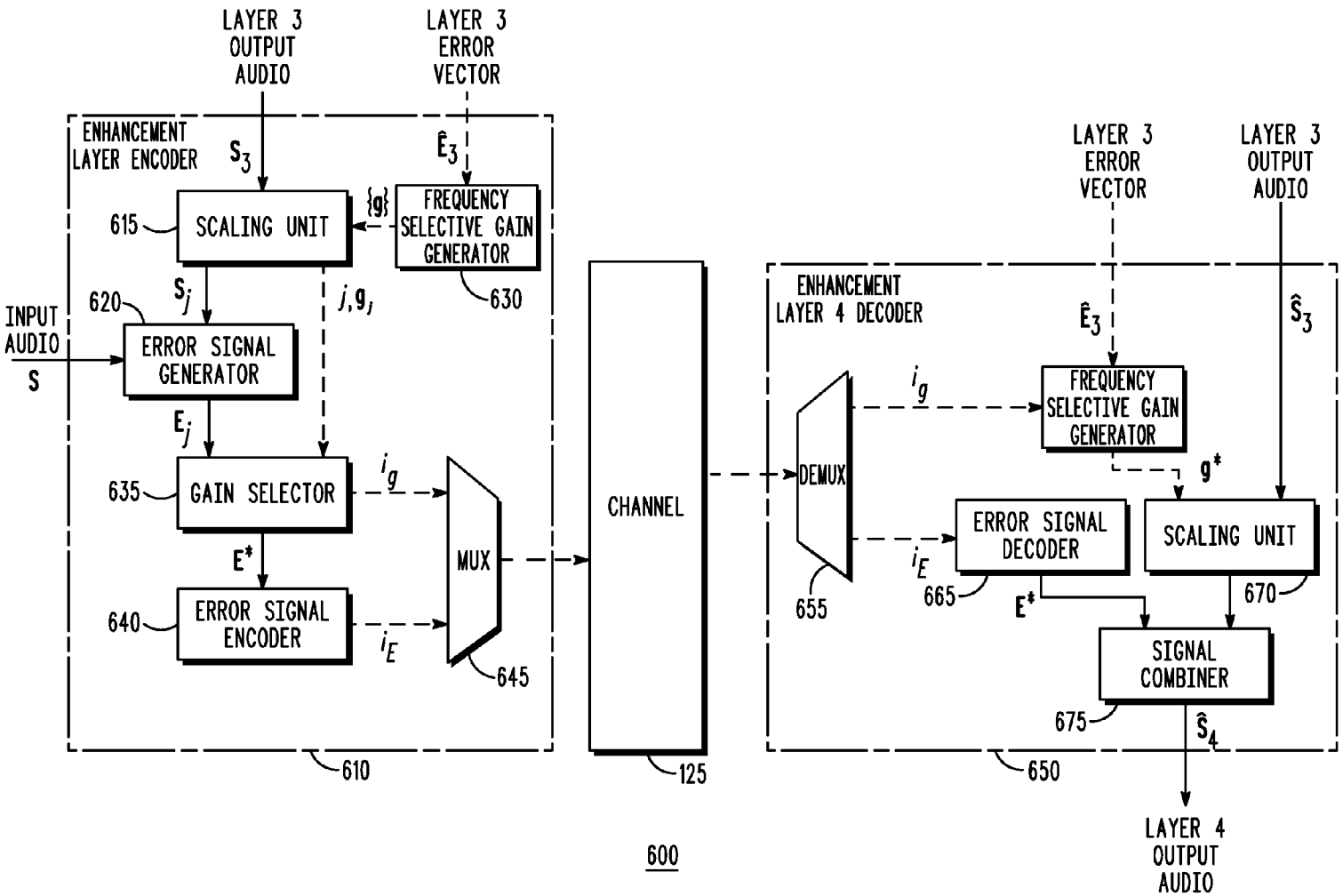
FIG. 6 is a block diagram of layer-4 encoder and decoder.

FIG. 6 is a block diagram showing layer 4 encoder 610 and decoder 650. The encoder and decoder shown in FIG. 6 are similar to those shown in FIG. 4, except that the gain value used by scaling units 615 and 670 is derived via frequency selective gain generators 630 and 660, respectively. During operation layer 3 audio output $S_3$ is output from layer 3 encoder and received by scaling unit 615. Additionally, layer 3 error vector $\hat{E}_3$ is output from layer 3 encoder 510 and received by frequency selective gain generator 630. As discussed, since the quantized error signal vector $\hat{E}_3$ may be limited in frequency range, the gain vector $g_j$ is adjusted based on, for example, the positions $k_s$ and $k_e$ as shown in equation 12, or the more general expression in equation 13.

The scaled audio $S_j$ is output from scaling unit 615 and received by error signal generator 620. As discussed above, error signal generator 620 receives the input audio signal S and determines an error value $E_j$ for each scaling vector utilized by scaling unit 615. These error vectors are passed to gain selector circuitry 635 along with the gain values used in determining the error vectors and a particular error E* based on the optimal gain value g*. A codeword ($i_g$) representing the optimal gain g* is output from gain selector 635, along with the optimal error vector E*, is passed to error signal encoder 640 where codeword $i_E$ is determined and output. Both $i_g$ and $i_E$ are output to multiplexer 645 and transmitted via channel 125 to layer 4 decoder 650.

During operation of layer 4 decoder 650, $i_g$ and $i_E$ are received from channel 125 and demultiplexed by demux 655. Gain codeword $i_g$ and the layer 3 error vector $\hat{E}_3$ are used as input to the frequency selective gain generator 660 to produce gain vector g* according to the corresponding method of encoder 610. Gain vector g* is then applied to the layer 3 reconstructed audio vector $\hat{S}_3$ within scaling unit 670, the output of which is then combined at signal combiner 675 with the layer 4 enhancement layer error vector E", which was obtained from error signal decoder 655 through decoding of codeword $i_E$, to produce the layer 4 reconstructed audio output $\hat{S}_4$ as shown.

Figure 7:
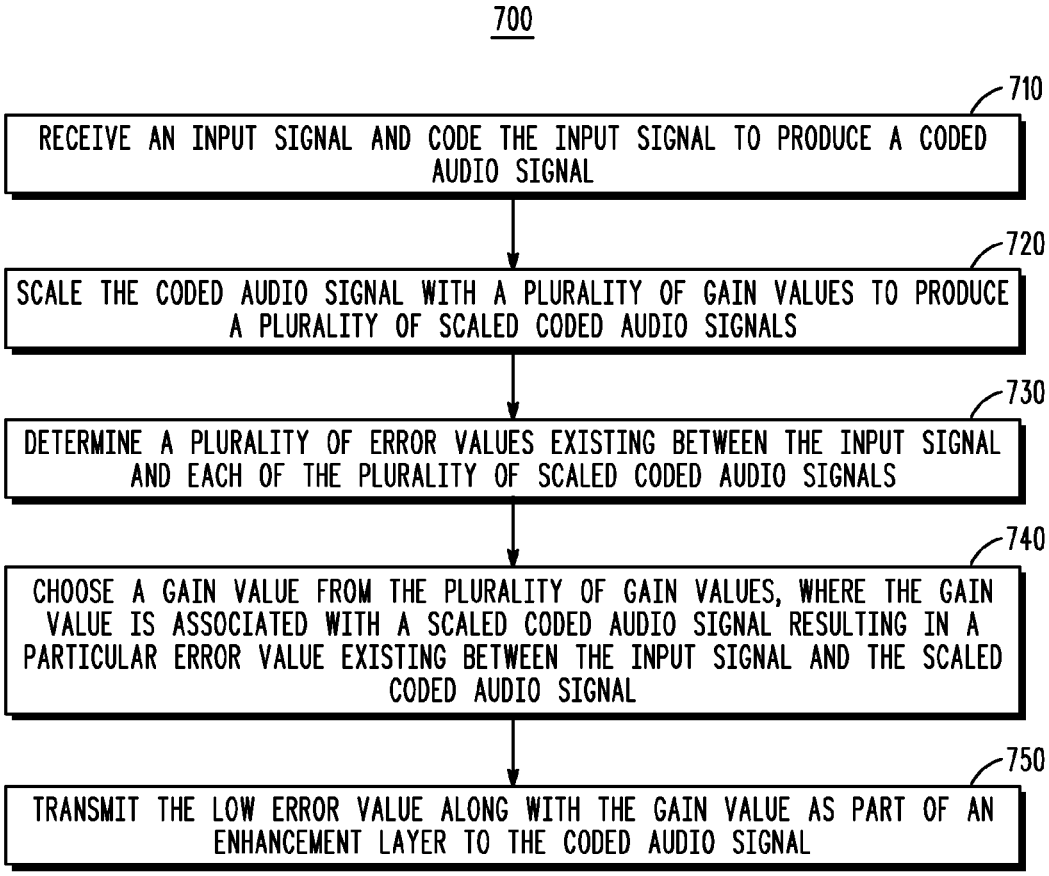
FIG. 7 is a flow chart showing operation of the encoders of FIG. 4 and FIG. 6.

FIG. 7 is a flow chart 700 showing the operation of an encoder according to the first and second embodiments of the present invention. As discussed above, both embodiments utilize an enhancement layer that scales the encoded audio with a plurality of scaling values and then chooses the scaling value resulting in a lowest error. However, in the second embodiment of the present invention, frequency selective gain generator 630 is utilized to generate the gain values.

The logic flow begins at Block 710 where a core layer encoder receives an input signal to be coded and codes the input signal to produce a coded audio signal. Enhancement layer encoder 410 receives the coded audio signal ($s_c(n)$) and scaling unit 415 scales the coded audio signal with a plurality of gain values to produce a plurality of scaled coded audio signals, each having an associated gain value. (Block 720). At Block 730, error signal generator 420 determines a plurality of error values existing between the input signal and each of the plurality of scaled coded audio signals. Gain selector 425 then chooses a gain value from the plurality of gain values (Block 740). As discussed above, the gain value (g*) is associated with a scaled coded audio signal resulting in a low error value (E*) existing between the input signal and the scaled coded audio signal. Finally at Block 750 transmitter 440 transmits the low error value (E*) along with the gain value (g*) as part of an enhancement layer to the coded audio signal. As one of ordinary skill in the art will recognize, both E* and g* are properly encoded prior to transmission.

As discussed above, at the receiver side, the coded audio signal will be received along with the enhancement layer. The enhancement layer is an enhancement to the coded audio signal that comprises the gain value (g*) and the error signal (E*) associated with the gain value.

Core Layer Scaling for Stereo

In the above description, an embedded coding system was described in which each of the layers was coding a mono signal. Now an embedded coding system for coding stereo or other multiple channel signals. For brevity, the technology in the context of a stereo signal consisting of two audio inputs (sources) is described; however, the exemplary embodiments described herein can easily be extended to cases where the stereo signal has more than two audio inputs, as is the case in multiple channel audio inputs. For purposes of illustration and not limitation, the two audio inputs are stereo signals consisting of the left signal ($s_L$) and the right signal ($s_R$), where $s_L$ and $s_R$ are n-dimensional column vectors representing a frame of audio data. Again for brevity, an embedded coding system consisting of two layers namely a core layer and an enhancement layer will be discussed in detail. The proposed idea can easily be extended to multiple layer embedded coding system. Also the codec may not per say be embedded, i.e., it may have only one layer, with some of the bits of that codec are dedicated for stereo and rest of the bits for mono signal.

An embedded stereo codec consisting of a core layer that simply codes a mono signal and enhancement layers that code either the higher frequency or stereo signals is known. In that limited scenario, the core layer codes a mono signal (s), obtained from the combination of $s_L$ and $s_R$, to produce a coded mono signal ŝ. Let H be a 2×1 combining matrix used for generating a mono signal, i.e., $$s=(s_L s_R)H \tag{17}$$

It is noted that in equation (17), $s_R$ may be a delayed version of the right audio signal instead of just the right channel signal. For example, the delay may be calculated to maximize the correlation of $s_L$ and the delayed version of $s_R$. If the matrix H is $[0.5\ 0.5]^T$, then equation 17 results in an equal weighting of the respective right and left channels, i.e., $s=0.5s_L+0.5s_R$. The embodiments presented herein are not limited to core layer coding the mono signal and enhancement layer coding the stereo signal. Both the core layer of the embedded codec as well as the enhancement layer may code multi-channel audio signals. The number of channels in the multi channel audio signal which are coded by the core layer multi-channel may be less than the number of channels in the multi channel audio signal which may be coded by the enhancement layer. Let (m, n) be the numbers of channels to be coded by core layer and enhancement layer, respectively. Let $s_1, s_2, s_3, \ldots, s_n$ be a representation of n audio channels to coded by the embedded system. The m-channels to be coded by the core layer are derived from these and are obtained as $$[s^1\ s^2\ s^m]\ [s_1\ s_2 \ldots s_n]\ H, \tag{17a}$$

where H is a n×m matrix.

As mentioned before, the core layer encodes a mono signal to produce a core layer coded signal ŝ. In order to generate estimates of the stereo components from $\hat{s}$, a balance factor is calculated. This balance factor is computed as:

$$w_L = \frac{s_L^T s}{s^T s}, \quad w_R = \frac{s_R^T s}{s^T s} \tag{18}$$

It can be shown that if the combining matrix H is $[0.5\ 0.5]^T$, then $$w_L = 2 - w_R \tag{19}$$

Note that the ratio enables quantization of only one parameter and other can easily be extracted from the first. The stereo output are now calculated as $$\hat{s}_L = w_L\,\hat{s},\ \hat{s}_R = w_R\hat{s} \tag{20}$$

In the subsequent section, we will be working on frequency domain instead of time domain. So a corresponding signal in frequency domain is represented in capital letter, i.e., S, $\hat{S}$, $S_L$, $S_R$, $\hat{S}_L$, and $\hat{S}_R$ are the frequency domain representation of s, $\hat{s}$, $s_L$, $s_R$, $\hat{s}_L$, and $\hat{s}_R$, respectively. The balance factor in frequency domain is calculated using terms in frequency domain and is given by $$W_L = \frac{S_L^T S}{S^T S}, \quad W_R = \frac{S_R^T S}{S^T S} \tag{21}$$

and $$\hat{S}_L = W_L\hat{S},\ \hat{S}_R = W_R\hat{S} \tag{22}$$

In frequency domain, the vectors may be further split into non-overlapping sub vectors, i.e., a vector S of dimension n, may be split into t sub vectors, $S_1, S, \ldots, S_t$, of dimensions $m_1$, $m_2, \ldots m_t$, such that $$\sum_{k=1}^{t} m_k = n. \tag{23}$$

In this case a different balance factor can be computed for different sub vectors, i.e., $$W_{LK} = \frac{S_{LK}^T S_k}{S_k^T S_k},\ W_{Rk} = \frac{S_{RK}^T S_k}{S_k^T S_k} \tag{24}$$

The balance factor in this instance is independent of the gain consideration.

Figure 8:
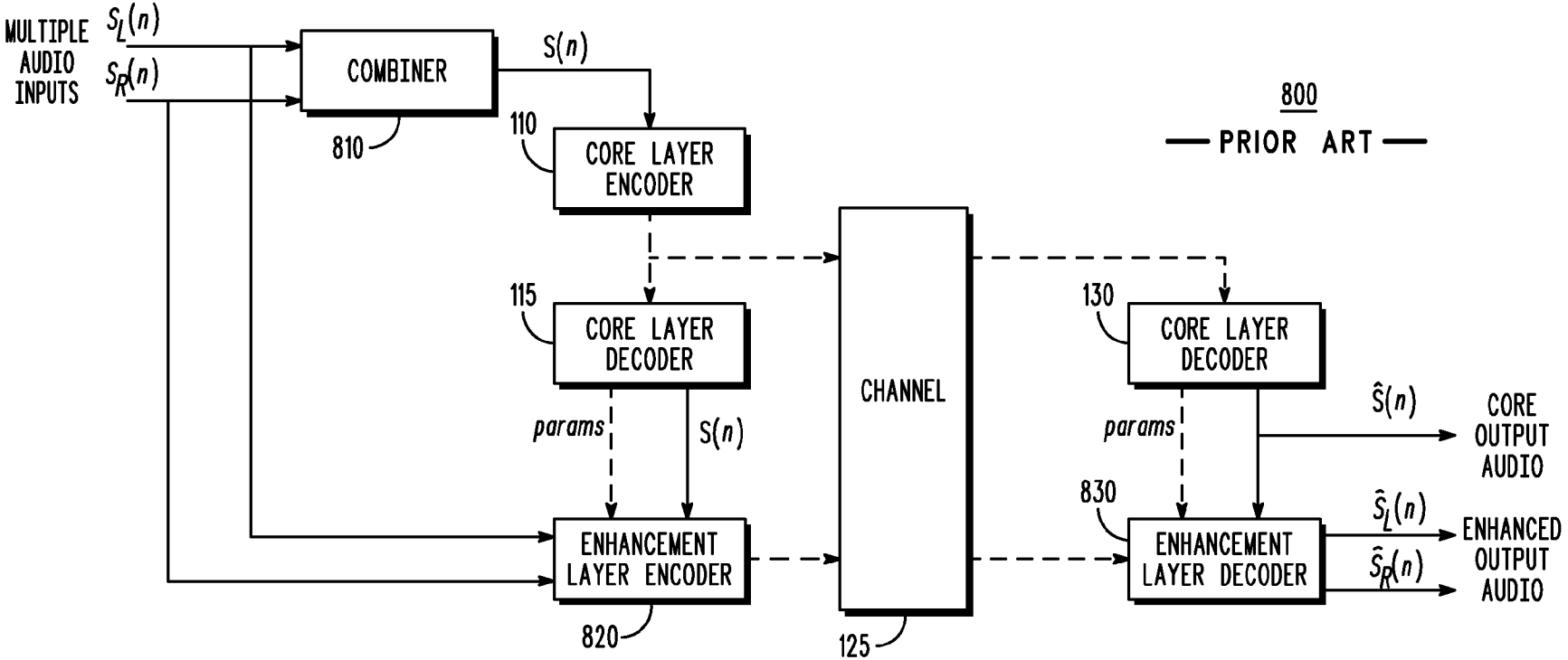
FIG. 8 is a block diagram of a prior art embedded speech/audio compression system.
Figure 9:
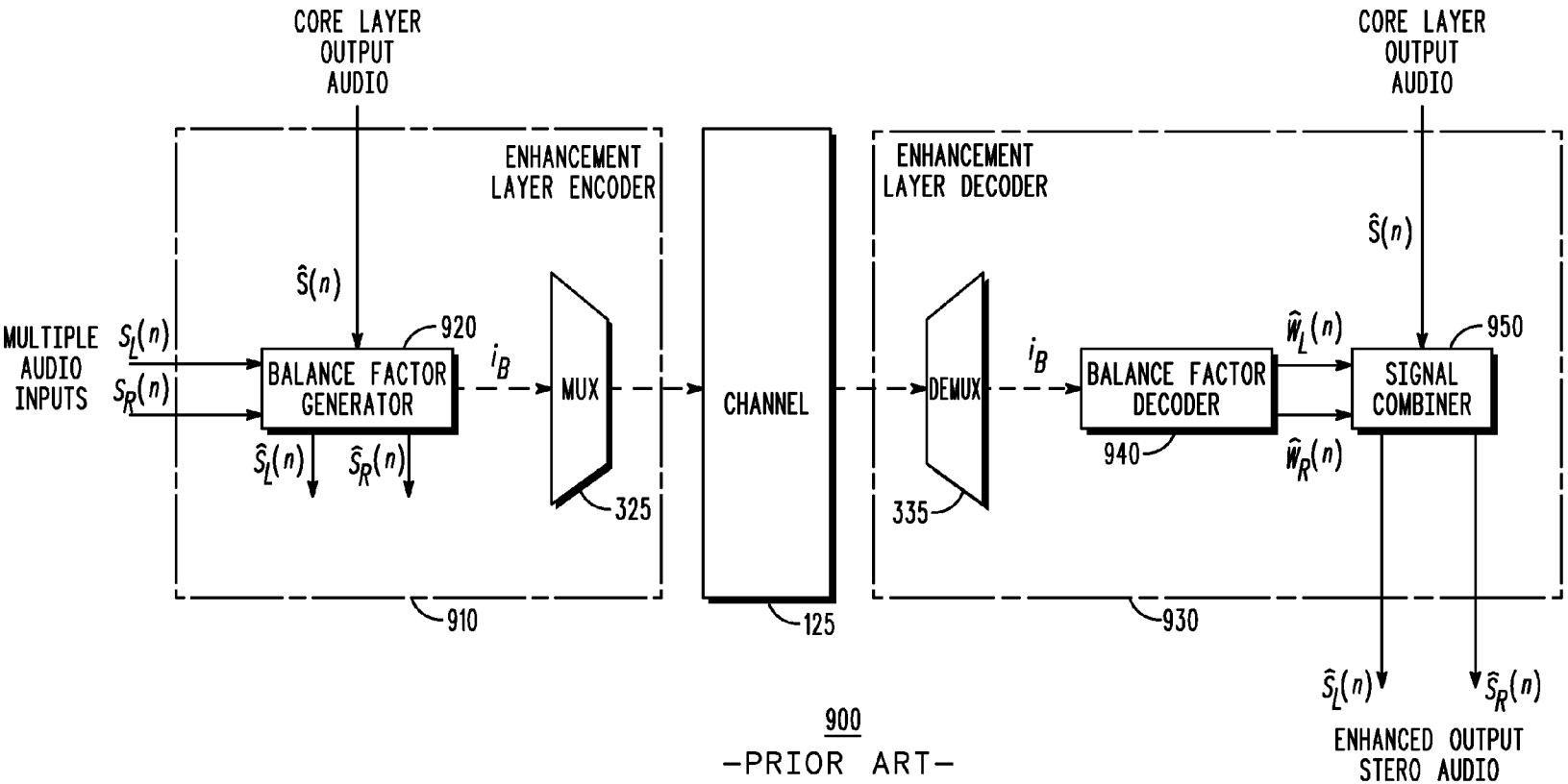
FIG. 9 is a more detailed example of the enhancement layer encoder of FIG. 8.

Referring now to FIGS. 8 and 9, prior art drawings relevant to stereo and other multiple channel signals is demonstrated. The prior art embedded speech/audio compression system 800 of FIG. 8 is similar to FIG. 1 but has multiple audio input signals, in this example shown as left and right stereo input signals S(n). These input audio signals are fed to combiner 810 which produces input audio s(n) as shown. The multiple input signals are also provided to enhancement layer encoder 820 as shown. On the decode side, enhancement layer decoder 830 produces enhanced output audio signals $\hat{s}_L$ $\hat{s}_R$ as shown.

FIG. 9 illustrates a prior enhancement layer encoder 900 as might be used in FIG. 8. The multiple audio inputs are provided to a balance factor generator, along with the core layer output audio signal as shown. Balance Factor Generator 920 of the enhancement layer encoder 910 receives the multiple audio inputs to produce signal $i_B$, which is passed along to MUX 325 as shown. The signal $i_B$ is a representation of the balance factor. In the preferred embodiment $i_B$ is a bit sequence representing the balance factors. On the decoder side, this signal $i_B$ is received by the balance factor decoder 940 which produces balance factor elements $W_L(n)$ and $W_R(n)$, as shown, which are received by signal combiner 950 as shown.

Multiple Channel Balance Factor Computation

As mentioned before, in many situations the codec used for coding of the mono signal is designed for single channel speech and it results in coding model noise whenever it is used for coding signals which are not fully supported by the codec model. Music signals and other non-speech like signals are some of the signals which are not properly modeled by a core layer codec that is based on a speech model. The description above, with regard to FIGS. 1-7, proposed applying a frequency selective gain to the signal coded by the core layer. The scaling was optimized to minimize a particular distortion (error value) between the audio input and the scaled coded signal. The approach described above works well for single channel signals but may not be optimum for applying the core layer scaling when the enhancement layer is coding the stereo or other multiple channel signals.

Since the mono component of the multiple channel signal, such as a stereo signal, is obtained from the combination of the two or more stereo audio inputs, the combined signal s also may not conform to the single channel speech model; hence the core layer codec may produce noise when coding the combined signal. Thus, there is a need for an approach that enables the scaling of the core layer coded signal in an embedded coding system, thereby reducing the noise generated by the core layer. In the mono signal approach described above, a particular distortion measure, on which the frequency selective scaling was obtained, was based on the error in the mono-signal. This error $E_4(j)$ is shown in equation (11) above. The distortion of just the mono-signal, however, is not sufficient to improve the quality of the stereo communication system. The scaling contained in equation (11) may be by a scaling factor of unity (1) or any other identified function.

For a stereo signal, a distortion measure should capture the distortion of both the right and the left channel. Let $E_L$ and $E_R$ be the error vector for the left and the right channels, respectively, and are given by $$E_L = S_L\hat{S}_L,\ E_R = S_R - \hat{S}_R \tag{25}$$

In the prior art, as described in the AMR-WB+ standard, for example, these error vectors are calculated as $$E_L = S_L - W_L\cdot\hat{S},\ E_R = S_R - W_R\cdot\hat{S}. \tag{26}$$

Now we consider the case where frequency selective gain vectors $g_j$ ($0 \leqq j < M$) is applied to $\hat{S}$. This frequency selective gain vector is represented in the matrix form as $G_j$, where $G_j$ is a diagonal matrix with diagonal elements $g_j$. For each vector $G_j$, the error vectors are calculated as:

$$E_L(j) = S_L - W_L\cdot G_j\cdot\hat{S},\ E_R(j) = S_R - W_R\cdot G_j\cdot\hat{S} \tag{27}$$

with the estimates of the stereo signals given by the terms $W\cdot G_j\cdot\hat{S}$. It can be seen that the gain matrix G may be unity matrix (1) or it may be any other diagonal matrix; it is recognized that not every possible estimate may run for every scaled signal.

The distortion measure $\epsilon$ which is minimized to improve the quality of stereo is a function of the two error vectors, i.e., $$\epsilon_j = f(E_L(j), E_R(j)) \tag{28}$$

It can be seen that the distortion value can be comprised of multiple distortion measures.

The index j of the frequency selective gain vector which is selected is given by:

$$j^* \underset{0 \le j < M}{\operatorname{argmin}} \epsilon_j \tag{29}$$

In an exemplary embodiment, the distortion measure is a mean squared distortion given by:

$$\epsilon_j \|E_L(j)\|^2 + \|E_R(j)\|^2 \tag{30}$$

Or it may be a weighted or biased distortion given by:

$$\epsilon_j = B_L \|E_L(j)\|^2 + B_R \|E_R(j)\|^2 \tag{31}$$

The bias $B_L$ and $B_R$ may be a function of the left and right channel energies.

As mentioned before, in frequency domain, the vectors may be further split into non-overlapping sub vectors. To extend the proposed technique to include the splitting of frequency domain vector into sub vectors, the balance factor used in (27) is computed for each sub vector. Thus, the error vectors $E_L$ and $E_R$ for each of the frequency selective gain is formed by concatenation of error sub vectors given by $$E_{Lk}(j) = S_{Lk} - W_{Lk} - G_{jk} \cdot \hat{S}_k,\ E_{Rk}(j) = S_{Rk} - W_{Rk} \cdot G_{jk} \cdot \hat{S}_k \tag{32}$$

The distortion measure $\epsilon$ in (28) is now a function of the error vectors formed by concatenation of above error sub vectors.

Computing Balance Factor

Figure 10:
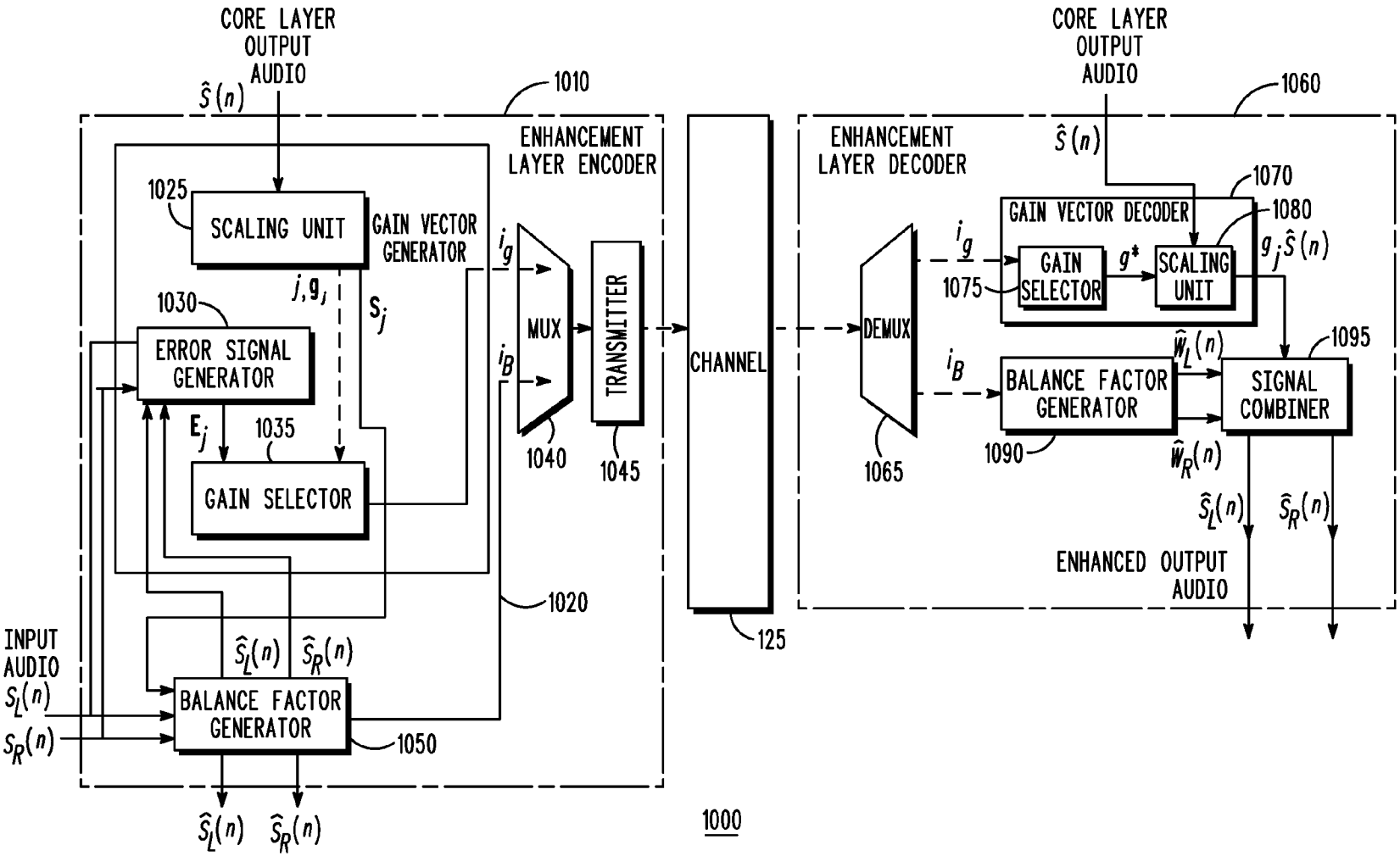
FIG. 10 is a block diagram of an enhancement layer encoder and decoder, in accordance with various embodiments.
Figure 11:
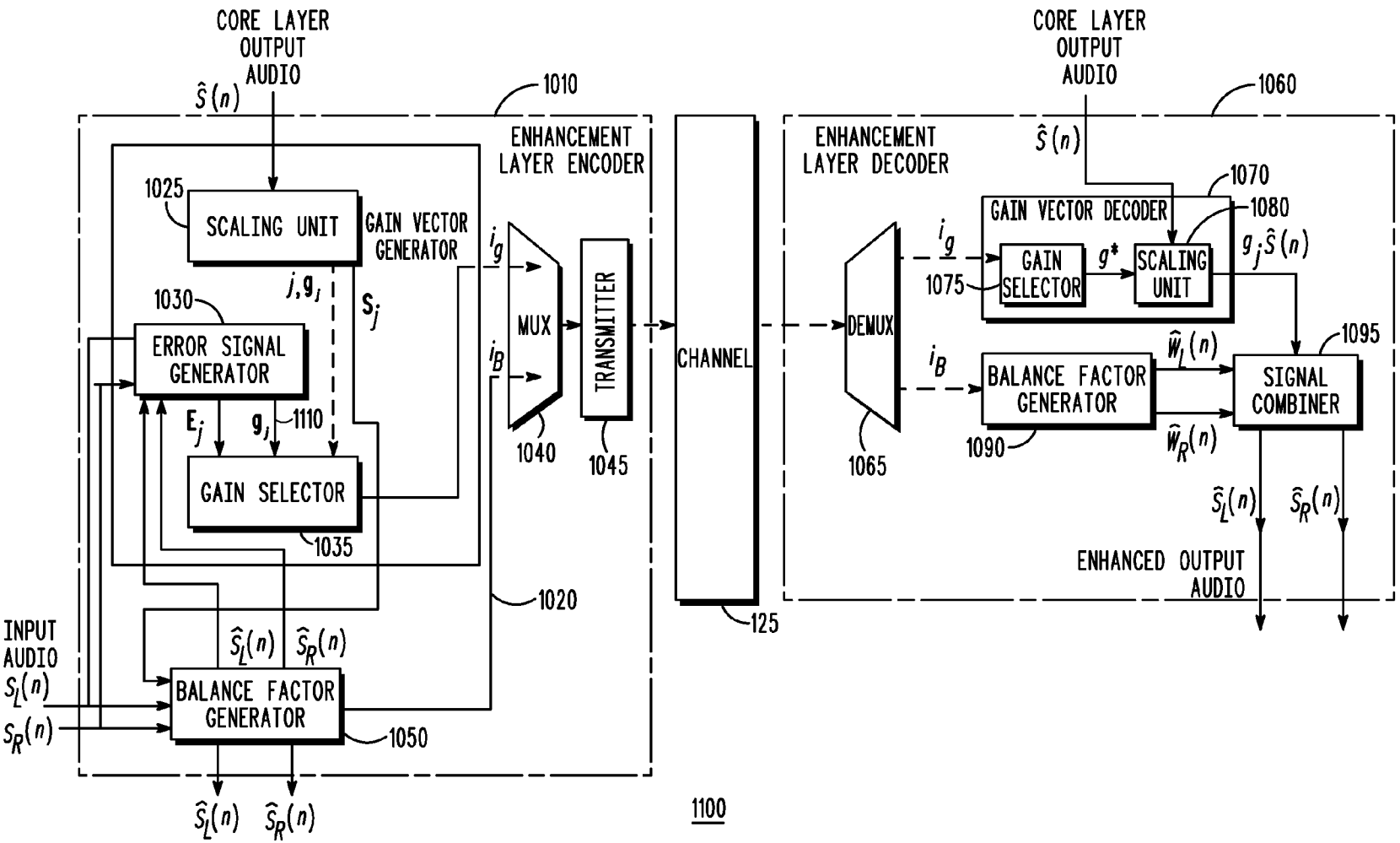
FIG. 11 is a block diagram of an enhancement layer encoder and decoder, in accordance with various embodiments.

The balance factor generated using the prior art (equation 21) is independent of the output of the core layer. However, in order to minimize a distortion measure given in (30) and (31), it may be beneficial to also compute the balance factor to minimize the corresponding distortion. Now the balance factor $W_L$ and $W_R$ may be computed as $$W_L(j) = \frac{S_L^T G_j \hat{S}}{\|G_j \hat{S}\|^2},\ W_R(j) = \frac{S_R^T G_j \hat{S}}{\|G_j \hat{S}\|^2}. \tag{33}$$

in which it can be seen that the balance factor is independent of gain, as is shown in the drawing of FIG. 11, for example. This equation minimizes the distortions in equation (30) and (31). The problem with using such a balance factor is that now:

$$W_L(j) \neq 2 - W_R(j) \tag{34}$$

hence separate bit fields may be needed to quantize $W_L$ and $W_R$. This may be avoided by putting the constraint $W_L(j)=2-W_R(j)$ on the optimization. With this constraint the optimum solution for equation (30) is given by:

$$W_L(j) = \frac{2B_R}{B_R + B_L} + \frac{(B_R S_R - B_L S_L)^T G_j \hat{S}}{\|G_j \hat{S}\|^2},\ W_R(j) = 2 - W_L(j) \tag{35}$$

in which the balance factor is dependent upon a gain term as shown; FIG. 10 of the drawings illustrate a dependent balance factor. If biasing factors $B_L$ and $B_R$ are unity, then $$W_L(j) = 1 - \frac{(S_L - S_R)^T G_j \hat{S}}{\|G_j \hat{S}\|^2},\ W_R(j) = 2 - W_L(j) \tag{36}$$

The terms $S^T G_j \hat{S}$ in equations (33) and (36) are representative of correlation values between the scaled coded audio signal and at least one of the audio signals of a multiple channel audio signal.

In stereo coding, the direction and location of origin of sound may be more important than the mean squared distortion. The ratio of left channel energy and the right channel energy may therefore be a better indicator of direction (or location of the origin of sound) rather than the minimizing a weighted distortion measure. In such scenarios, the balance factor computed in equation (35) and (36) may not be a good approach for calculating the balance factor. The need is to keep the ratio of left and right channel energy before and after coding the same. The ratio of channel energy before coding and after coding is given by:

$$v = \frac{\|S_L\|^2}{\|S_R\|^2},\ \hat{v} = \frac{W_L^2(j)\|\hat{S}\|^2}{W_R^2(j)\|\hat{S}\|^2}, \tag{37}$$

respectively. Equating these two energy ratios and using the assumption $W_L(j)=2-W_R(j)$, we get $$W_L = \frac{2\sqrt{S_L^T S_L}}{\sqrt{S_L^T S_L} + \sqrt{S_R^T S_R}},\ W_R = 2 - W_L. \tag{38}$$

which give the balance factor components of the generated balance factor. Note that the balance factor calculated in (38) is now independent of $G_j$, thus is no longer a function of j, providing a self-correlated balance factor that is independent of the gain consideration; a dependent balance factor is further illustrated in FIG. 10 of the drawings. Using this result with equations 29 and 32, we can extend the selection of the optimal core layer scaling index j to include the concatenated vector segments k, such that:

$$j^* = \underset{0 \le j < M}{\operatorname{argmin}} \left\{ \sum_k \left( \|S_{Lk} - W_{Lk} \cdot G_{jk} \cdot \hat{S}_k\|^2 + \|S_{Rk} - W_{Rk} \cdot G_{jk} \cdot \hat{S}_k\|^2 \right) \right\} \tag{39}$$

a representation of the optimal gain value. This index of gain value j* is transmitted as an output signal of the enhancement layer encoder.

Referring now to FIG. 10, a block diagram 1000 of an enhancement layer encoder and enhancement layer decoder in accordance with various embodiments is illustrated. The input audio signals s(n) are received by balance factor generator 1050 of enhancement layer encoder 1010 and error signal (distortion signal) generator 1030 of the gain vector generator 1020. The coded audio signal from the core layer $\hat{S}(n)$ is received by scaling unit 1025 of the gain vector generator 1020 as shown. Scaling unit 1025 operates to scale the coded audio signal $\hat{S}(n)$ with a plurality of gain values to generate a number of candidate coded audio signals, where at least one of the candidate coded audio signals is scaled. As previously mentioned, scaling by unity or any desired identify function may be employed. Scaling unit 1025 outputs scaled audio $S_j$, which is received by balance factor generator 1030. Generating the balance factor having a plurality of balance factor components, each associated with an audio signal of the multiple channel audio signals received by enhancement layer encoder 1010, was discussed above in connection with Equations (18), (21), (24) and (33). This is accomplished by balance factor generator 1050 as shown, to produce balance factor components $\hat{S}_L(n)$, $\hat{S}_R(n)$, as shown.

As discussed in connection with equation (38), above, balance factor generator 1030 illustrates balance factor as independent of gain.

The gain vector generator 1020 is responsible for determining a gain value to be applied to the coded audio signal to generate an estimate of the multiple channel audio signal, as discussed in Equations (27), (28) and (29). This is accomplished by the scaling unit 1025 and balance factor generator 1050, which work together to generate the estimate based upon the balance factor and at least one scaled coded audio signal. The gain value is based on the balance factor and the multiple channel audio signal wherein the gain value is configured to minimize a distortion value between the multiple channel audio signal and the estimate of the multiple channel audio signal. Equation (30) discusses generating a distortion value as a function of the estimate of the multiple channel input signal and the actual input signal itself. Thus, the balance factor components are received by error signal generator 1030, together with the input audio signals s(n), to determine an error value $E_j$ for each scaling vector utilized by scaling unit 1025. These error vectors are passed to gain selector circuitry 1035 along with the gain values used in determining the error vectors and a particular error E* based on the optimal gain value g*. The gain selector 1035, then, is operative to evaluate the distortion value based on the estimate of the multiple channel input signal and the actual signal itself in order to determine a representation of an optimal gain value g* of the possible gain values. A codeword ($i_g$) representing the optimal gain g* is output from gain selector 1035 and received by MUX multiplexor 1040 as shown.

Both $i_g$ and $i_B$ are output to multiplexer 1040 and transmitted by transmitter 1045 to enhancement layer decoder 1060 via channel 125. The representation of the gain value $i_g$ is output for transmission to Channel 125 as shown but it may also be stored if desired.

On the decoder side, during operation of the enhancement layer decoder 1060, $i_g$ and $i_E$ are received from channel 125 and demultiplexed by demux 1065. Thus, enhancement layer decoder receives a coded audio signal $\hat{S}(n)$, a coded balance factor $i_B$ and a coded gain value $i_g$. Gain vector decoder 1070 comprises a frequency selective gain generator 1075 and a scaling unit 1080 as shown. The gain vector decoder 1070 generates a decoded gain value from the coded gain value. The coded gain value $i_g$ is input to frequency selective gain generator 1075 to produce gain vector g* according to the corresponding method of encoder 1010. Gain vector g* is then applied to the scaling unit 1080, which scales the coded audio signal $\hat{S}(n)$ with the decoded gain value g* to generate scaled audio signal. Signal combiner 1095 receives the coded balance factor output signals of balance factor decoder 1090 to the scaled audio signal $G_j\hat{S}(n)$ to generate and output a decoded multiple channel audio signal, shown as the enhanced output audio signals.

Block diagram 1100 of an exemplary enhancement layer encoder and enhancement layer decoder in which, as discussed in connection with equation (33), above, balance factor generator 1030 generates a balance factor that is dependent on gain. This is illustrated by error signal generator which generates $G_j$ signal 1110.

Figure 12:
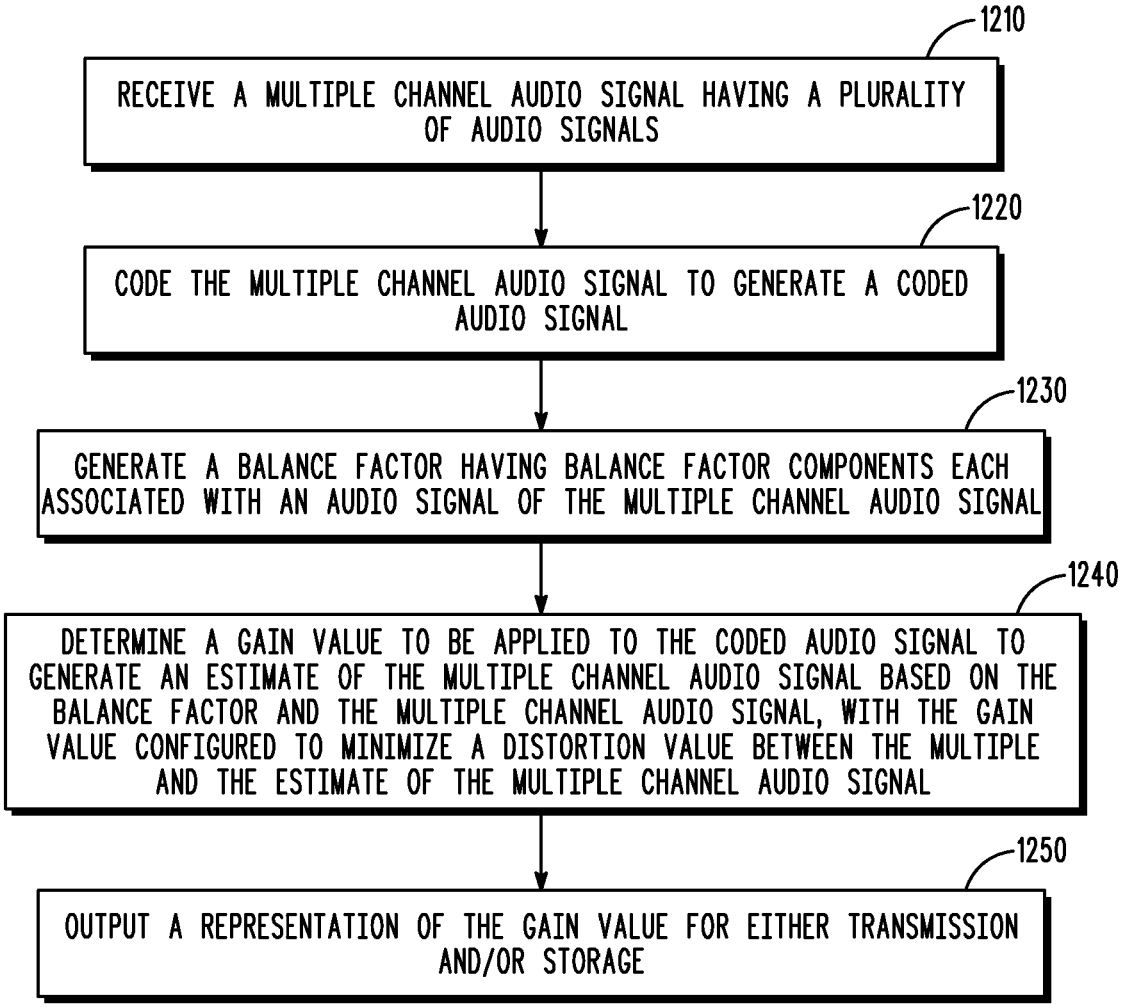
FIG. 12 is a flowchart of multiple channel audio signal encoding, in accordance with various embodiments.
Figure 13:
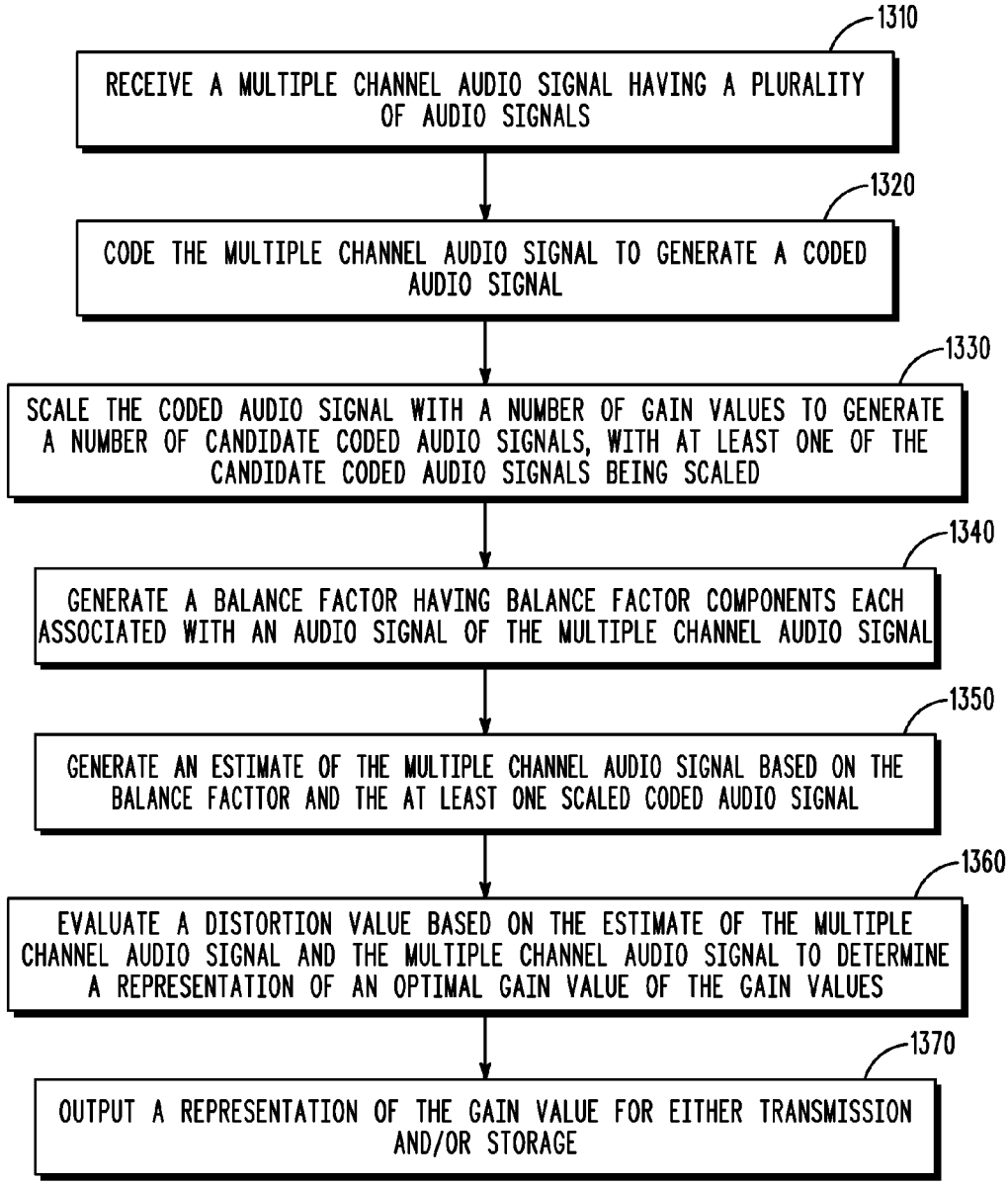
FIG. 13 is a flowchart of multiple channel audio signal encoding, in accordance with various embodiments.
Figure 14:
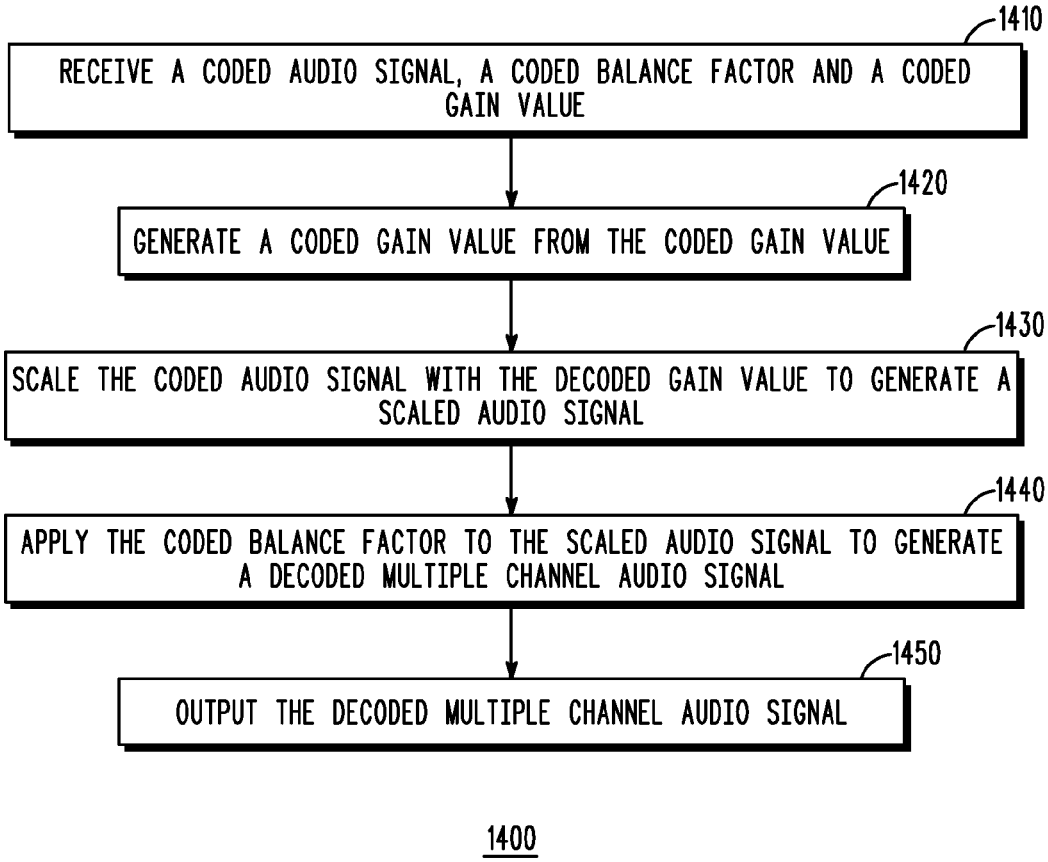
FIG. 14 is a flowchart of decoding of a multiple channel audio signal, in accordance with various embodiments.

Referring now to FIGS. 12-14, flows are presented which cover the methodology of the various embodiments presented herein. In flow 1200 of FIG. 12, a method for coding a multiple channel audio signal is presented. At Block 1210, a multiple channel audio signal having a plurality of audio signals is received. At Block 1220, the multiple channel audio signal is coded to generate a coded audio signal. The coded audio signal may be either a mono- or a multiple channel signal, such as a stereo signal as illustrated by way of example in the drawings. Moreover, the coded audio signal may comprise a plurality of channels. There may be more than one channel in the core layer and the number of channels in the enhancement layer may be greater than the number of channels in the core layer. Next, at Block 1230, a balance factor having balance factor components each associated with an audio signal of the multiple channel audio signal is generated. Equations (18), (21), (24) and (33) describe generation of the balance factor. Each balance factor component may be dependent upon other balance factor components generated, as is the case in Equation (38). Generating the balance factor may comprise generating a correlation value between the scaled coded audio signal and at least one of the audio signals of the multiple channel audio signal, such as in Equations (33) and (36). A self-correlation between at least one of the audio signals may be generated, as in Equation (38), from which a square root can be generated. At Block 1240, a gain value to be applied to the coded audio signal to generate an estimate of the multiple channel audio signal based on the balance factor and the multiple channel audio signal is determined. The gain value is configured to minimize a distortion value between the multiple channel audio signal and the estimate of the multiple channel audio signal. Equations (27), (28), (29) and (30) describe determining the gain value. A gain value may be chosen from a plurality of gain values to scale the coded audio signal and to generate the scaled coded audio signals. The distortion value may be generated based on this estimate; the gain value may be based upon the distortion value. At Block 1250, a representation of the gain value is output for either transmission and/or storage.

Flow 1300 of FIG. 13 describes another methodology for coding a multiple channel audio signal, in accordance with various embodiments. At Block 1310 a multiple channel audio signal having a plurality of audio signals is received. At Block 1320, the multiple channel audio signal is coded to generate a coded audio signal. The processes of Blocks 1310 and 1320 are performed by a core layer encoder, as described previously. As recited previously, the coded audio signal may be either a mono- or a multiple channel signal, such as a stereo signal as illustrated by way of example in the drawings. Moreover, the coded audio signal may comprise a plurality of channels. There may be more than one channel in the core layer and the number of channels in the enhancement layer may be greater than the number of channels in the core layer.

At Block 1330, the coded audio signal is scaled with a number of gain values to generate a number of candidate coded audio signals, with at least one of the candidate coded audio signals being scaled. Scaling is accomplished by the scaling unit of the gain vector generator. As discussed, scaling the coded audio signal may include scaling with a gain value of unity. The gain value of the plurality of gain values may be a gain matrix with vector $g_j$ as the diagonal component as previously described. The gain matrix may be frequency selective. It may be dependent upon the output of the core layer, the coded audio signal illustrated in the drawings. A gain value may be chosen from a plurality of gain values to scale the coded audio signal and to generate the scaled coded audio signals. At Block 1340, a balance factor having balance factor components each associated with an audio signal of the multiple channel audio signal is generated. The balance factor generation is performed by the balance factor generator. Each balance factor component may be dependent upon other balance factor components generated, as is the case in Equation (38). Generating the balance factor may comprise generating a correlation value between the scaled coded audio signal and at least one of the audio signals of the multiple channel audio signal, such as in Equations (33) and (36). A self-correlation between at least one of the audio signals may be generated, as in Equation (38) from which a square root can be generated.

At Block 1350, an estimate of the multiple channel audio signal is generated based on the balance factor and the at least one scaled coded audio signal. The estimate is generated based upon the scaled coded audio signal(s) and the generated balance factor. The estimate may comprise a number of estimates corresponding to the plurality of candidate coded audio signals. A distortion value is evaluated and/or may be generated based on the estimate of the multiple channel audio signal and the multiple channel audio signal to determine a representation of an optimal gain value of the gain values at Block 1360. The distortion value may comprise a plurality of distortion values corresponding to the plurality of estimates. Evaluation of the distortion value is accomplished by the gain selector circuitry. The presentation of an optimal gain value is given by Equation (39). At Block 1370, a representation of the gain value may be output for either transmission and/or storage. The transmitter of the enhancement layer encoder can transmit the gain value representation as previously described.

The process embodied in the flowchart 1400 of FIG. 14 illustrates decoding of a multiple channel audio signal. At Block 1410, a coded audio signal, a coded balance factor and a coded gain value are received. A decoded gain value is generated from the coded gain value at Block 1420. The gain value may be a gain matrix, previously described and the gain matrix may be frequency selective. The gain matrix may also be dependent on the coded audio received as an output of the core layer. Moreover, the coded audio signal may be either a mono- or a multiple channel signal, such as a stereo signal as illustrated by way of example in the drawings. Additionally, the coded audio signal may comprise a plurality of channels. For example, there may be more than one channel in the core layer and the number of channels in the enhancement layer may be greater than the number of channels in the core layer.

At Block 1430, the coded audio signal is scaled with the decoded gain value to generate a scaled audio signal. The coded balance factor is applied to the scaled audio signal to generate a decoded multiple channel audio signal at Block 1440. The decoded multiple channel audio signal is output at Block 1450.

Selective Scaling Mask Computation Based on Peak Detection

The frequency selective gain matrix $G_j$, which is a diagonal matrix with diagonal elements forming a gain vector $g_j$, may be defined as in (14) above:

$$g_j(k) = \begin{cases} \alpha 10^{(-j\cdot\Delta/20)}; & k_l \le k \le k_h \\ \alpha; & \text{otherwise,} \end{cases} \quad 0 \le j < M, \tag{40}$$

where $\Delta$ is a step size (e.g., $\Delta \approx 2.0$ dB), $\alpha$ is a constant, M is the number of candidates (e.g., M=8, which can be represented using only 3 bits), and $k_l$ and $k_h$ are the low and high frequency cutoffs, respectively, over which the gain reduction may take place. Here k represents the $k^{th}$ MDCT or Fourier Transform coefficient. Note that $g_j$ is frequency selective but it is independent of the previous layer's output. The gain vectors $g_j$ may be based on some function of the coded elements of a previously coded signal vector, in this case $\hat{S}$. This can be expressed as:

$$g_j(k)=f(k,\hat{S}). \tag{41}$$

In a multi layered embedded coding system (with more than 2 layers), in which the output $\hat{S}$ which is to be scaled by the gain vector $g_j$, is obtained from the contribution of at least two previous layers. That is $$\hat{S}=\hat{E}_2+\hat{S}_1, \tag{42}$$

where $\hat{S}_1$ is the output of the first layer (core layer) and $\hat{E}_2$ is the contribution of the second layer or the first enhancement layer. In this case gain vectors $g_j$ may be some function of the coded elements of a previously coded signal vector $\hat{S}$ and the contribution of the first enhancement layer:

$$g_j(k)=f(k, \hat{S}, \hat{E}_2). \tag{43}$$

It has been observed that most of audible noise because of coding model of the lower layer is in the valleys and not in the peaks. In other words, there is a better match between the original and the coded spectrum at the spectral peaks. Thus peaks should not be altered, i.e., scaling should be limited to the valleys. To advantageously use this observation, in one of the embodiments the function in equation (41) is based on peaks and valleys of $\hat{S}$. Let $\Psi(\hat{S})$ be a scaling mask based on the detected peak magnitudes of $\hat{S}$. The scaling mask may be a vector valued function with non-zero values at the detected peaks, i.e.

$$\psi(\hat{S}) = \begin{cases} \hat{s}_i & \text{peak present} \\ 0 & \text{Otherwise,} \end{cases} \tag{44}$$

where $\hat{s}_i$ is the $i^{th}$ element of $\hat{S}$. The equation (41) can now be modified as:

$$g_j(k) = f(k, \hat{S}) = \begin{cases} \alpha 10^{(-j\cdot\Delta/20)}; & k_l \le k \le k_h, \psi_k(\hat{S}) = 0 \\ \alpha; & \text{otherwise} \end{cases} \quad 0 \le j < M \tag{45}$$

Various approaches can be used for peak detection. In the preferred embodiment, the peaks are detected by passing the absolute spectrum $|\hat{S}|$ through two separate weighted averaging filters and then comparing the filtered outputs. Let $A_1$ and $A_2$ be the matrix representation of two averaging filter. Let $l_1$ and $l_2$ ($l_1>l_2$) be the lengths of the two filters. The peak detecting function is given as:

$$\psi(\hat{S}) = \begin{cases} \hat{s}_i & A_2|\hat{S}| > \beta\cdot A_1|\hat{S}| \\ 0 & \text{Otherwise,} \end{cases} \tag{46}$$

where $\beta$ is an empirical threshold value.

Figure 15:
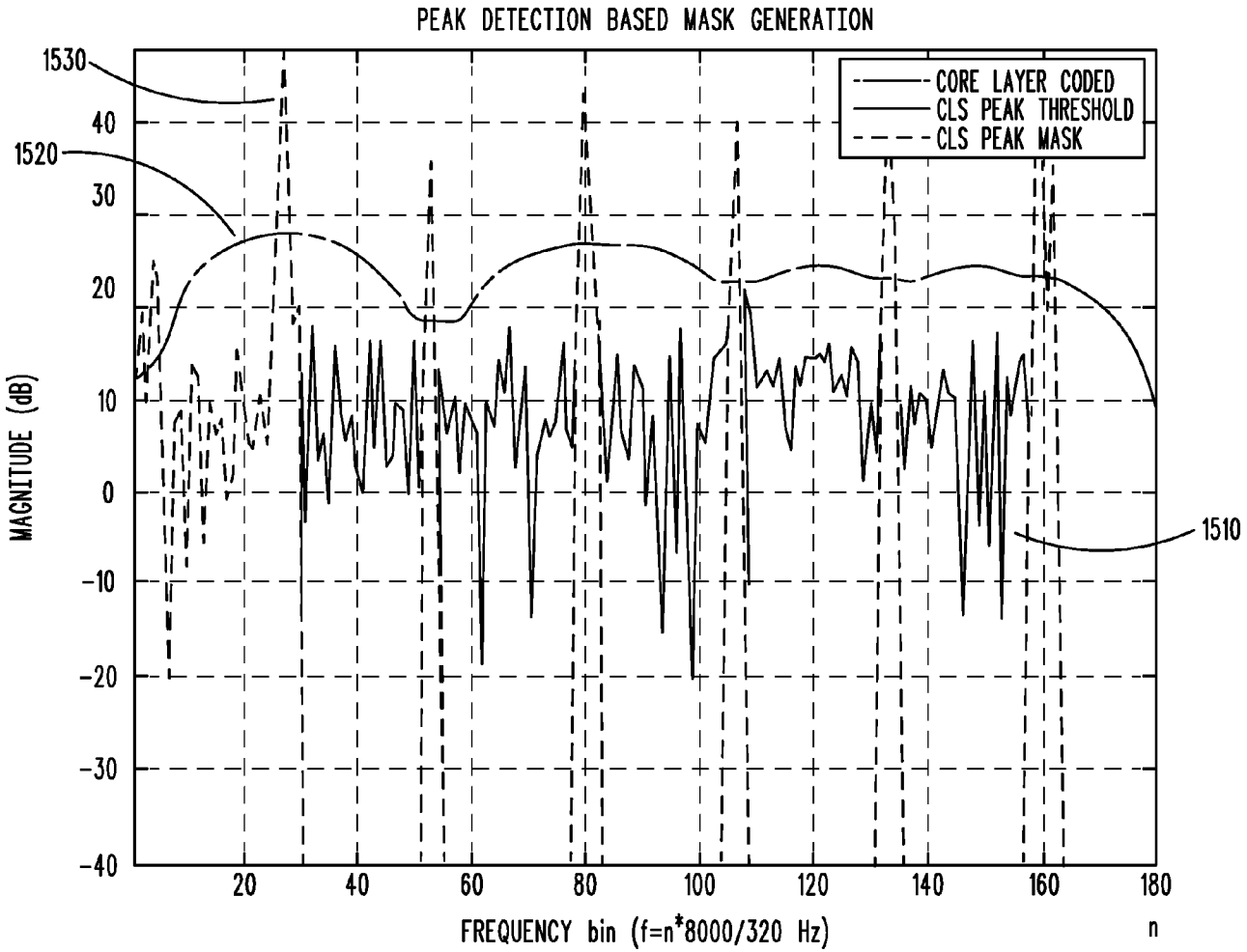
FIG. 15 is a frequency plot of peak detection based on mask generation, in accordance with various embodiments.
Figure 16:
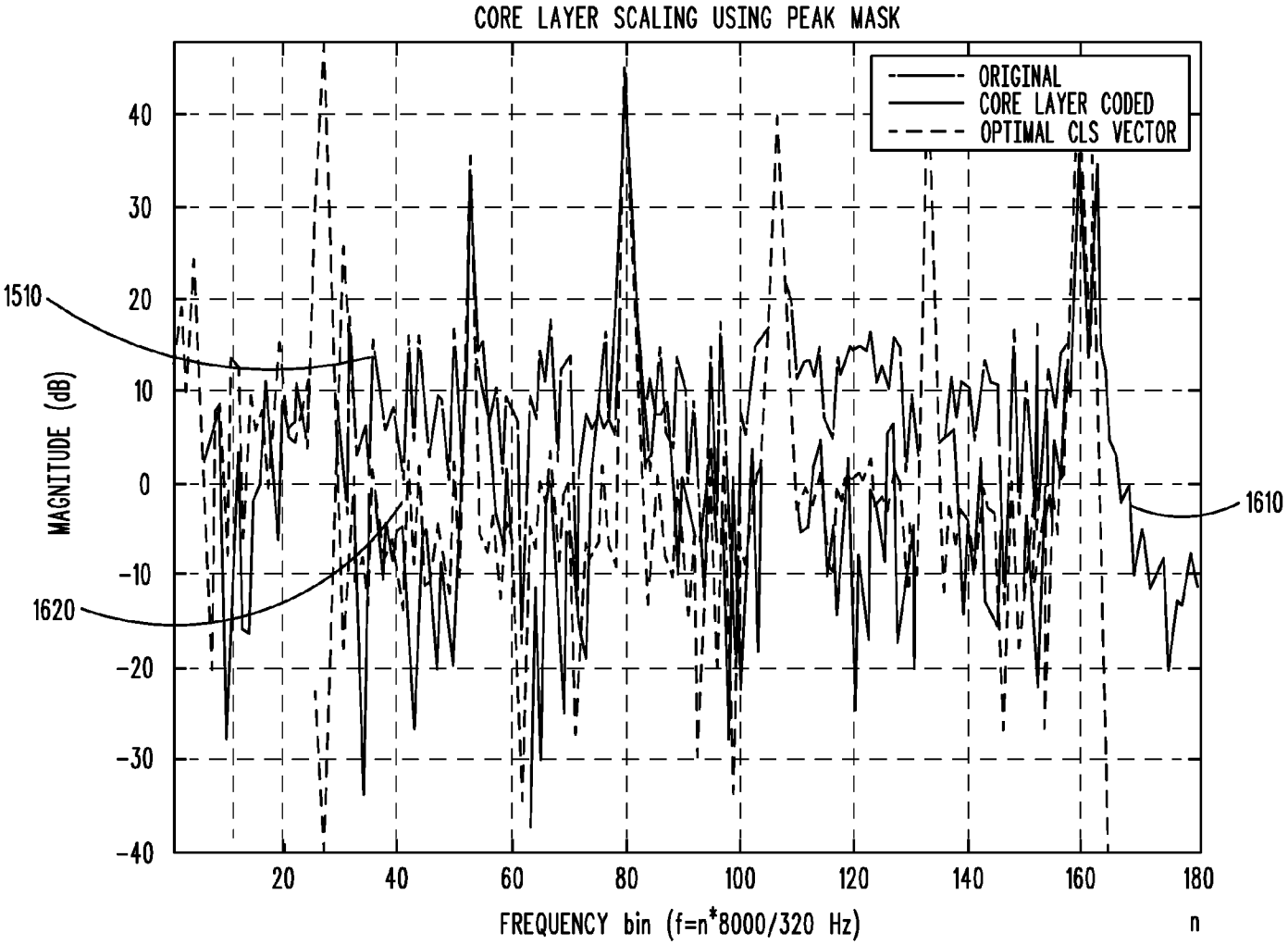
FIG. 16 is a frequency plot of core layer scaling using peak mask generation, in accordance with various embodiments.

As an illustrative example, refer to FIG. 15 and FIG. 16. Here, the absolute value of the coded signal $|\hat{S}|$ in the MDCT domain is given in both plots as 1510. This signal is representative of a sound from a "pitch pipe", which creates a regularly spaced harmonic sequence as shown. This signal is difficult to code using a core layer coder based on a speech model because the fundamental frequency of this signal is beyond the range of what is considered reasonable for a speech signal. This results in a fairly high level of noise produced by the core layer, which can be observed by comparing the coded signal 1510 to the mono version of the original signal $|S|$ (1610).

From the coded signal (1510), a threshold generator is used to produce threshold 1520, which corresponds to the expression $\beta A_1|\hat{S}|$ in equation 45. Here $A_1$ is a convolution matrix which, in the preferred embodiment, implements a convolution of the signal $|\hat{S}|$ with a cosine window of length 45. Many window shapes are possible and may comprise different lengths. Also, in the preferred embodiment, $A_2$ is an identity matrix. The peak detector then compares signal 1510 to threshold 1520 to produce the scaling mask $\psi(\hat{S})$, shown as 1530.

The core layer scaling vector candidates (given in equation 45) can then be used to scale the noise in between peaks of the coded signal $|\hat{S}|$ to produce a scaled reconstructed signal 1620. The optimum candidate may be chosen in accordance with the process described in equation 39 above or otherwise.

Figure 17:
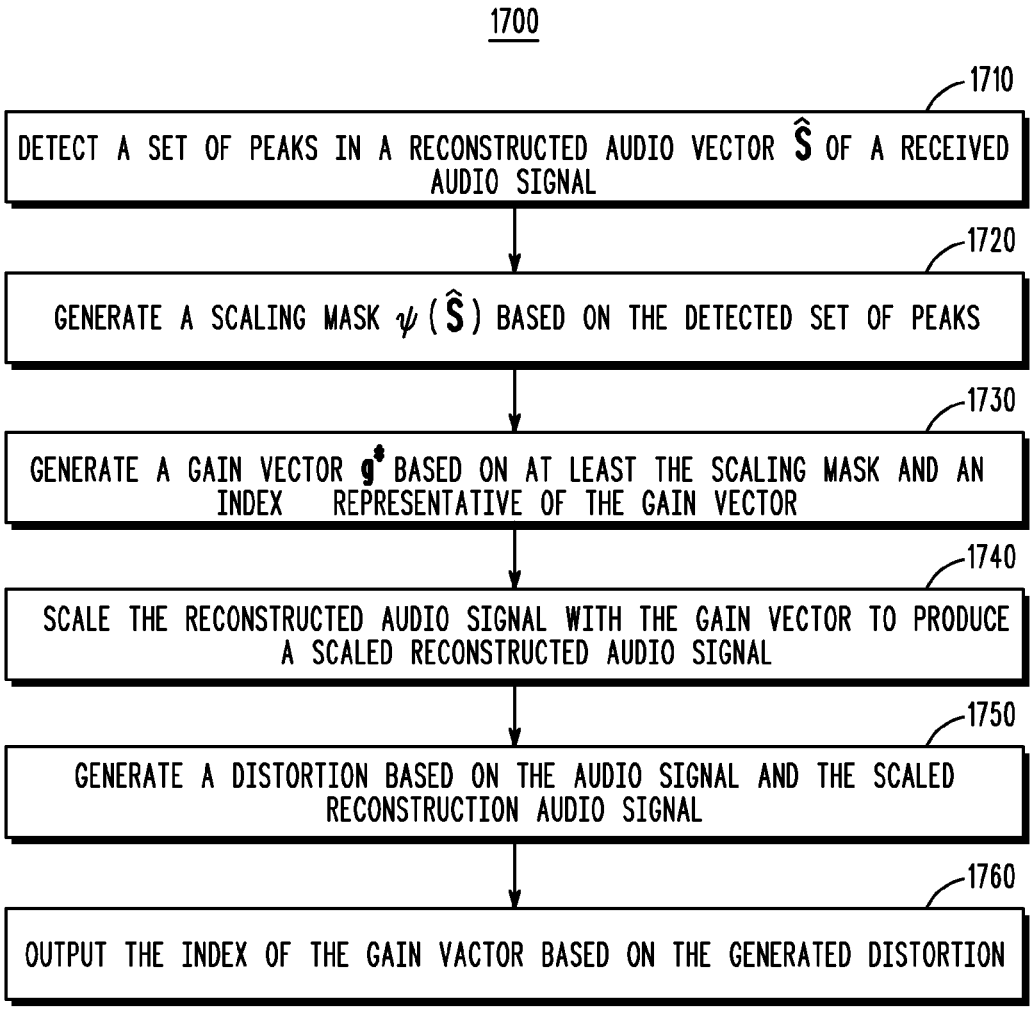
FIGS. 17-19 are flow diagrams illustrating methodology for encoding and decoding using mask generation based on peak detection, in accordance with various embodiments.
Figure 18:
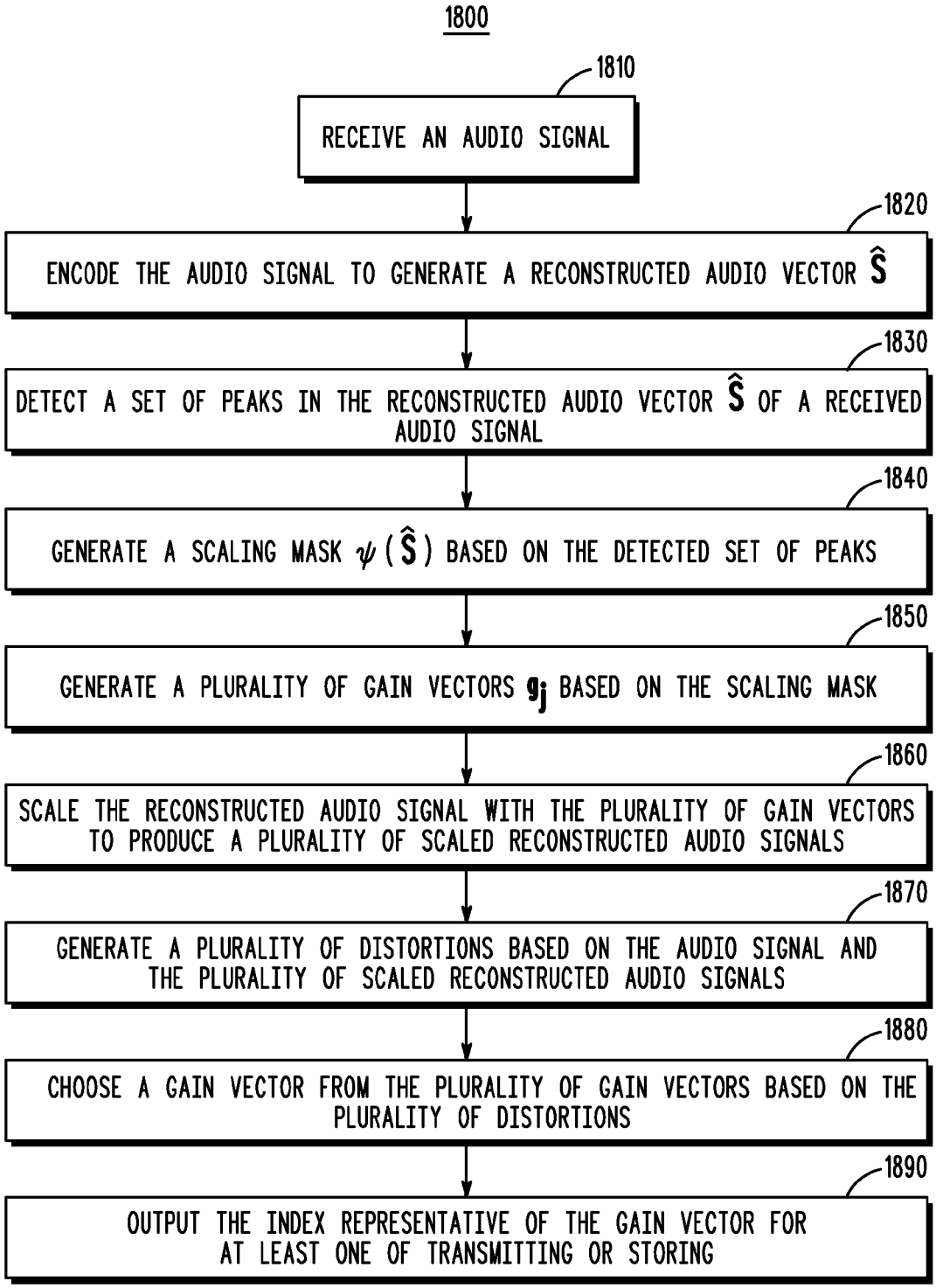
Figure 19:
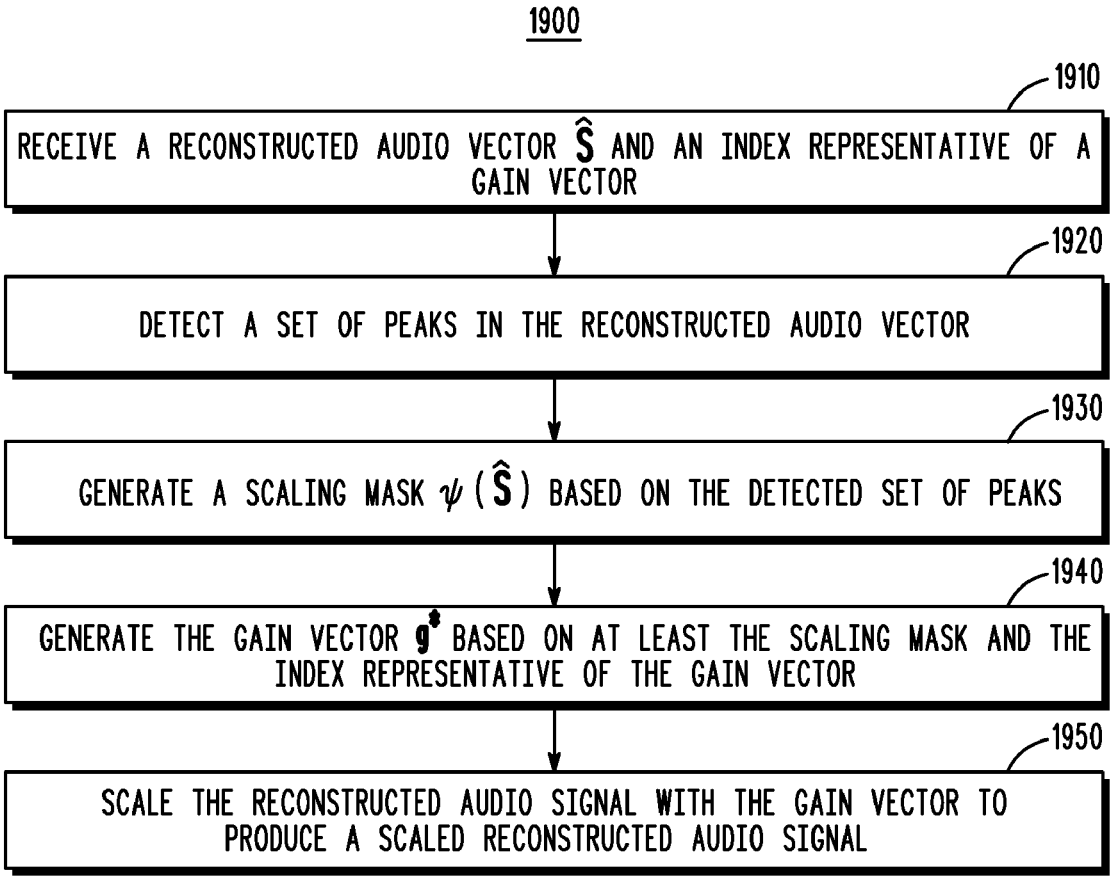

Referring now to FIGS. 17-19, flow diagrams are presented that illustrate methodology associated with selective scaling mask computation based on peak detection discussed above in accordance with various embodiments. In the flow diagram 1700 of FIG. 17, at Block 1710 a set of peaks in a reconstructed audio vector $\hat{S}$ of a received audio signal is detected. The audio signal may be embedded in multiple layers. The reconstructed audio vector $\hat{S}$ may be in the frequency domain and the set of peaks may be frequency domain peaks. Detecting the set of peaks is performed in accordance with a peak detection function given by equation (46), for example. It is noted that the set can be empty, as is the case in which everything is attenuated and there are no peaks. At Block 1720, a scaling mask $\psi(\hat{S})$ based on the detected set of peaks is generated. Then, at Block 1730, a gain vector g* based on at least the scaling mask and an index j representative of the gain vector is generated. At Block 1740, the reconstructed audio signal with the gain vector to produce a scaled reconstructed audio signal is scaled. A distortion based on the audio signal and the scaled reconstructed audio signal is generated at Block 1750. The index of the gain vector based on the generated distortion is output at Block 1760.

Referring now to FIG. 18, flow diagram 1800 illustrates an alternate embodiment of encoding an audio signal, in accordance with certain embodiments. At Block 1810, an audio signal is received. The audio signal may be embedded in multiple layers. The audio signal is then encoded At Block 1820 to generate a reconstructed audio vector §. The reconstructed audio vector $\hat{S}$ may be in the frequency domain and the set of peaks may be frequency domain peaks. At Block 1830, a set of peaks in the reconstructed audio vector $\hat{S}$ of a received audio signal are detected. Detecting the set of peaks is performed in accordance with a peak detection function given by equation (46), for example. Again, it is noted that the set can be empty, as is the case in which everything is attenuated and there are no peaks. A scaling mask $\psi(\hat{S})$ based on the detected set of peaks is generated at Block 1840. At Block 1850, a plurality of gain vectors $g_j$ based on the scaling mask are generated. The reconstructed audio signal is scaled with the plurality of gain vectors to produce a plurality of scaled reconstructed audio signals at Block 1860. Next, a plurality of distortions based on the audio signal and the plurality of scaled reconstructed audio signals are generated at Block 1870. A gain vector is chosen from the plurality of gain vectors based on the plurality of distortions at Block 1880. The gain vector may be chosen to correspond with a minimum distortion of the plurality of distortions. The index representative of the gain vector is output to be transmitted and/or stored at Block 1890.

The encoder flows illustrated in FIGS. 17-18 above can be implemented by the apparatus structure previously described. With reference to the flow 1700, in an apparatus operable to code an audio signal, a gain selector, such as gain selector 1035 of gain vector generator 1020 of enhancement layer encoder 1010, detects a set of peaks in a reconstructed audio vector $\hat{S}$ of a received audio signal and generates a scaling mask $\psi(\hat{S})$ based on the detected set of peaks. Again, the audio signal may be embedded in multiple layers. The reconstructed audio vector $\hat{S}$ may be in the frequency domain and the set of peaks may be frequency domain peaks. Detecting the set of peaks is performed in accordance with a peak detection function given by equation (46), for example. It is noted that the set of peaks can be nil if everything in the signal has been attenuated. A scaling unit, such as scaling unit 1025 of gain vector generator 1020 generates a gain vector g* based on at least the scaling mask and an index j representative of the gain vector, scales the reconstructed audio signal with the gain vector to produce a scaled reconstructed audio signal. Error signal generator 1030 of gain vector generator 1025 generates a distortion based on the audio signal and the scaled reconstructed audio signal. A transmitter, such as transmitter 1045 of enhancement layer decoder 1010 is operable to output the index of the gain vector based on the generated distortion.

With reference to the flow 1800 of FIG. 18, in an apparatus operable to code an audio signal, an encoder received an audio signal and encodes the audio signal to generate a reconstructed audio vector $\hat{S}$. A scaling unit such as scaling unit 1025 of gain vector generator 1020 detects a set of peaks in the reconstructed audio vector of a received audio signal, generates a scaling mask $\psi(\hat{S})$ based on the detected set of peaks, generates a plurality of gain vectors gj based on the scaling mask, and scales the reconstructed audio signal with the plurality of gain vectors to produce the plurality of scaled reconstructed audio signals. Error signal generator 1030 generates a plurality of distortions based on the audio signal and the plurality of scaled reconstructed audio signals. A gain selector such as gain selector 1035 chooses a gain vector from the plurality of gain vectors based on the plurality of distortions. Transmitter 1045, for example, outputs for later transmission and/or storage, the index representative of the gain vector.

In flow diagram 1900 of FIG. 19, a method of decoding an audio signal is illustrated. A reconstructed audio vector $\hat{S}$ and an index representative of a gain vector is received at Block 1910. At Block 1920, a set of peaks in the reconstructed audio vector is detected. Detecting the set of peaks is performed in accordance with a peak detection function given by equation (46), for example. Again, it is noted that the set can be empty, as is the case in which everything is attenuated and there are no peaks. A scaling mask $\psi(\hat{S})$ based on the detected set of peaks is generated at Block 1930. The gain vector g* based on at least the scaling mask and the index representative of the gain vector is generated at Block 1940. The reconstructed audio vector is scaled with the gain vector to produce a scaled reconstructed audio signal at Block 1950. The method may further include generating an enhancement to the reconstructed audio vector and then combining the scaled reconstructed audio signal and the enhancement to the reconstructed audio vector to generate an enhanced decoded signal.

The decoder flow illustrated in FIG. 19 can be implemented by the apparatus structure previously described. In an apparatus operable to decode an audio signal, a gain vector decoder 1070 of an enhancement layer decoder 1060, for example, receives a reconstructed audio vector $\hat{S}$ and an index representative of a gain vector $i_g$. As shown in FIG. 10, $i_g$ is received by gain selector 1075 while reconstructed audio vector $\hat{S}$ is received by scaling unit 1080 of gain vector decoder 1070. A gain selector, such as gain selector 1075 of gain vector decoder 1070, detects a set of peaks in the reconstructed audio vector, generates a scaling mask $\omega(\hat{S})$ based on the detected set of peaks, and generates the gain vector g* based on at least the scaling mask and the index representative of the gain vector. Again, the set can be empty of file if the signal is mostly attenuated. The gain selector detects the set of peaks in accordance with a peak detection function such as that given in equation (46), for example. A scaling unit 1080, for example, scales the reconstructed audio vector with the gain vector to produce a scaled reconstructed audio signal.

Further, an error signal decoder such as error signal decoder 665 of enhancement layer decoder in FIG. 6 may generate an enhancement to the reconstructed audio vector. A signal combiner, like signal combiner 675 of FIG. 6, combines the scaled reconstructed audio signal and the enhancement to the reconstructed audio vector to generate an enhanced decoded signal.

It is further noted that the balance factor directed flows of FIGS. 12-14 and the selective scaling mask with peak detection directed flows of FIGS. 17-19 may be both performed in various combination and such is supported by the apparatus and structure described herein.

While the invention has been particularly shown and described with reference to a particular embodiment, it will be understood by those skilled in the art that various changes in form and details may be made therein without departing from the spirit and scope of the invention. For example, while the above techniques are described in terms of transmitting and receiving over a channel in a telecommunications system, the techniques may apply equally to a system which uses the signal compression system for the purposes of reducing storage requirements on a digital media device, such as a solid-state memory device or computer hard disk. It is intended that such changes come within the scope of the following claims.

What is claimed is:

1. A multiple channel audio signal coding apparatus comprising:

an encoder configured to generate a coded audio signal by coding a multiple channel audio signal that comprises a plurality of audio signals;

an enhancement layer encoder balance factor generator configured to generate a balance factor having a plurality of balance factor components each associated with an audio signal of the multiple channel audio signal;

an enhancement layer encoder gain vector generator configured to determine a gain value to be applied to the coded audio signal and to generate an estimate of the multiple channel audio signal based on the balance factor and the multiple channel audio signal, wherein the gain value is configured to minimize a distortion value between the multiple channel audio signal and the estimate of the multiple channel audio signal; and a transmitter configured to transmit a representation of the gain value.

2. The apparatus of claim 1 further comprising:

an enhancement layer encoder scaling unit configured to scale the coded audio signal with a plurality of gain values to generate a plurality of candidate coded audio signals, wherein at least one of the candidate coded audio signals is scaled;

the scaling unit and the balance factor generator configured to generate the estimate of the multiple channel audio signal based on the balance factor and the at least one scaled coded audio signal of the plurality of candidate coded audio signals; and an enhancement layer encoder gain selector configured to evaluate the distortion value based on the estimate of the multiple channel audio signal and the multiple channel audio signal to determine a representation of an optimal gain value of the plurality of gain values.

3. The apparatus of claim 1, wherein the encoder encodes the audio signal to generate a reconstructed audio vector $\hat{S}$ and the gain vector generator further comprising:

a scaling unit configured to detect a set of peaks in the reconstructed audio vector $\hat{S}$ of a received audio signal, to generate a scaling mask $\omega(\hat{S})$ based on the detected set of peaks, to generate a plurality of gain vectors gj based on the scaling mask, and to scale the reconstructed audio signal with the plurality of gain vectors to produce the plurality of scaled reconstructed audio signals;

an error signal generator configured to generate a plurality of distortions based on the audio signal and the plurality of scaled reconstructed audio signals; and a gain selector configured to select a gain vector from the plurality of gain vectors based on the plurality of distortions, wherein the transmitter outputs for at least one of transmitting and storing the index representative of the gain vector.

4. The apparatus of claim 3, wherein the gain selector is configured to detect the set of peaks further in accordance with a peak detection function given as:

$$\psi(\hat{S}) = \begin{cases} \hat{s}_i & A_2|\hat{S}| > \beta \cdot A_1|\hat{S}| \\ 0 & \text{Otherwise,} \end{cases}$$

where β is a threshold value.

5. A multiple channel audio signal coding apparatus comprising:

an encoder configured to generate a coded audio signal by coding a multiple channel audio signal that comprises a plurality of audio signals;

an enhancement layer encoder scaling unit configured to generate a plurality of candidate coded audio signals by scaling the coded audio signal with a plurality of gain values, wherein at least one of the candidate coded audio signals is scaled;

a balance factor generator configured to generate a balance factor having a plurality of balance factor components each associated with an audio signal of the plurality of audio signals of the multiple channel audio signal;

the scaling unit and the balance factor generator generate an estimate of the multiple channel audio signal based on the balance factor and the at least one scaled coded audio signal of the plurality of candidate coded audio signals;

a gain selector of the enhancement layer encoder configured to evaluate a distortion value based on the estimate of the multiple channel audio signal and the multiple channel audio signal to determine a representation of an optimal gain value of the plurality of gain values;

a transmitter configured to transmit the representation of the optimal gain value.

6. The apparatus of claim 5, wherein a gain value of the plurality of gain values is a gain matrix with vector $g_j$ as the diagonal component and wherein the gain matrix is frequency selective.

7. The apparatus of claim 5, wherein the representation of the optimal gain value is given by:

$$j^* = \underset{0 \le j < M}{\operatorname{argmin}} \left\{ \sum_k \left( \left\| S_{Lk} - W_{Lk} \cdot G_{jk} \cdot \hat{S}_k \right\|^2 + \left\| S_{Rk} - W_{Rk} \cdot G_{jk} \cdot \hat{S}_k \right\|^2 \right) \right\}.$$

8. The apparatus of claim 5, wherein each balance factor component is given by:

$$W_L = \frac{2\sqrt{S_L^T S_L}}{\sqrt{S_L^T S_L} + \sqrt{S_R^T S_R}}, \; W_R = 2 - W_L.$$

9. The apparatus of claim 5, wherein the balance factor generator is configured to generate a correlation value between the scaled coded audio signal and at least one of the audio signals of the multiple channel audio signal.

10. The apparatus of claim 5, wherein the balance factor generator is configured to generate a self correlation between at least one of the audio signals of the multiple channel audio signal and generates a square root of the self correlation.

11. The apparatus of claim 5, wherein the gain selector is configured to generate a distortion value based on the estimate of the multiple channel audio signal and the multiple channel audio signal and wherein the gain value is based upon the distortion value.

12. The apparatus of claim 5, wherein the estimate comprises a plurality of estimates corresponding to the plurality of candidate coded audio signals.

13. The apparatus of claim 5, wherein the coded audio signal is one of a mono and a multiple channel signal.

14. The apparatus of claim 13, wherein the coded multiple channel audio signal is a stereo signal.

15. A method for coding a multiple channel audio signal, the method comprising:

receiving a multiple channel audio signal that comprises a plurality of audio signals;

generating a coded audio signal based on the multiple channel audio signal;

generating a balance factor having a plurality of balance factor components each associated with an audio signal of the multiple channel audio signal;

determining a gain value to be applied to the coded audio signal to generate an estimate of the multiple channel audio signal based on the balance factor and the multiple channel audio signal, wherein the gain value is configured to minimize a distortion value between the multiple channel audio signal and the estimate of the multiple channel audio signal; and outputting a representation of the gain value.

16. The method of claim 15 further comprising:

scaling the coded audio signal with a plurality of gain values to generate a plurality of candidate coded audio signals, wherein at least one of the candidate coded audio signals is scaled;

generating the estimate of the multiple channel audio signal based on the balance factor and the at least one scaled coded audio signal of the plurality of candidate coded audio signals; and evaluating the distortion value based on the estimate of the multiple channel audio signal and the multiple channel audio signal to determine a representation of an optimal gain value of the plurality of gain values.

17. The method of claim 15, detecting a set of peaks in a reconstructed audio vector $\hat{S}$ of a received audio signal;

generating a scaling mask $\psi(\hat{S})$ based on the detected set of peaks;

generating a gain vector g* based on at least the scaling mask and an index j representative of the gain vector;

scaling the reconstructed audio signal with the gain vector to produce a scaled reconstructed audio signal;

generating a distortion based on the audio signal and the scaled reconstructed audio signal; and outputting the index of the gain vector based on the generated distortion.

18. The method of claim 15, further comprising:

receiving an audio signal;

encoding the audio signal to generate a reconstructed audio vector $\hat{S}$;

detecting a set of peaks in the reconstructed audio vector $\hat{S}$ of a received audio signal;

generating a scaling mask $\omega(\hat{S})$ based on the detected set of peaks;

generating a plurality of gain vectors $g_j$ based on the scaling mask;

scaling the reconstructed audio signal with the plurality of gain vectors to produce the plurality of scaled reconstructed audio signals;

generating a plurality of distortions based on the audio signal and a plurality of scaled reconstructed audio signals;

choosing a gain vector from the plurality of gain vectors based on the plurality of distortions; and outputting for at least one of transmitting and storing the index representative of the gain vector.

* * * * *